US005688622A

United States Patent [19]

Ito et al.

[11] Patent Number: 5,688,622

[45] Date of Patent: Nov. 18, 1997

[54] DEVELOPING METHOD

[75] Inventors: Noboru Ito, Kawanishi; Tamotsu Shimizu, Settsu; Eiji Gyoutoku, Amagasaki, all of Japan

[73] Assignee: Minolta Co., Ltd., Osaka, Japan

[21] Appl. No.: 717,750

[22] Filed: Sep. 23, 1996

Related U.S. Application Data

[63] Continuation of Ser. No. 518,276, Aug. 23, 1995, abandoned.

[30] Foreign Application Priority Data

| | | | |
|---|---|---|---|
| Sep. 9, 1994 | [JP] | Japan | 6-242009 |
| Sep. 9, 1994 | [JP] | Japan | 6-242010 |
| Sep. 9, 1994 | [JP] | Japan | 6-242011 |

[51] Int. Cl.[6] ..... G03G 13/09; G03G 13/08

[52] U.S. Cl. ..... 430/102; 430/106.6; 430/108; 430/111; 430/122

[58] Field of Search ..... 430/102, 106.6, 430/111, 122

[56] References Cited

U.S. PATENT DOCUMENTS

| | | | |
|---|---|---|---|
| 4,284,702 | 8/1981 | Tabuchi et al. | 430/122 |
| 4,447,517 | 5/1984 | Yuge et al. | 430/122 |
| 4,675,267 | 6/1987 | Haneda et al. | 430/122 |
| 4,797,335 | 1/1989 | Hiratsuka et al. | 430/122 |
| 4,885,222 | 12/1989 | Kaneko et al. | 430/102 |

FOREIGN PATENT DOCUMENTS

| | | |
|---|---|---|
| 61-32858 | 2/1986 | Japan . |
| 62-75687 | 4/1987 | Japan . |
| 62-178277 | 8/1987 | Japan . |
| 62-178278 | 8/1987 | Japan . |
| 62-182760 | 8/1987 | Japan . |
| 63-170660 | 7/1988 | Japan . |
| 5-323681 | 12/1993 | Japan . |

*Primary Examiner*—Roland Martin

*Attorney, Agent, or Firm*—Burns, Doane, Swecker & Mathis, LLP

[57] ABSTRACT

A developing method for developing an electrostatic latent image at a developing region includes preparing a developer containing toner particles and carrier particles which has an inherent resistance value of $1\times10^{7}$~$1\times10^{12}$ Ωcm under an electric field of 500V/mm, magnetic force of 600~2300 G, and a mean particle size of 10~30 μm; regulating a quantity of the prepared developer on a developer transporter within a range of 0.7~5.0 mg/cm$^2$; transporting the regulated developer to the developing region; and applying an alternating current voltage between the developing region and the electrostatic latent image to generate an oscillating electric field therebetween in order to supply the transported developer to the electrostatic latent image.

20 Claims, 10 Drawing Sheets

DEVELOPING METHOD

This application is a continuation of application Ser. No. 08/518,276, filed Aug. 23, 1995 now abandoned.

BACKGROUND OF THE INVENTION

1. Field of the Invention

The present invention relates to a developing method for developing with toner latent images formed on an image-bearing member in image forming apparatus such as copiers, printers and the like.

2. Description of the Related Art

Various conventional methods are known for developing with toner latent images formed on image-bearing members in image forming apparatus such as copiers, printers and the like. Typical of such developing methods are methods wherein developer comprising a toner and a carrier is supplied on a developer transporting member such as a developing sleeve, developer supplied on the developer transporting member is transported to an image-bearing member in a magnetic brush state on said developer transporting member, the amount of developer on said developer transporting member is regulated by a regulating member and is thereafter delivered to a developing region opposite said image-bearing member, developer in the developing region comes into contact with the surface of the image-bearing member while in a magnetic brush state on the developer transporting member, and the toner contained in the developer is supplied from the developer transporting member to the image-bearing member to develop the latent image thereon.

Research by the present inventors has discovered that when the carrier particle size is too large or the magnetic force is excessively strong, the carrier is affected by magnetic attraction on the sleeve and the texture of the image is disrupted. The resistance value of the carrier also has a large influence. When the carrier resistance value is too high, such as when development is accomplished by a developer 1 using a high resistance carrier as shown in FIG. 1, the lines of electric force circumscribe the edges of the electrostatic latent image formed on an image-bearing member 2 making the field at the edges stronger, such that a so-called edge effect is produced wherein toner T is excessively supplied to the edges of the image causing irregularity of the obtained image. In printers and digital copiers which have come into widespread use in recent years, the aforesaid disadvantage is particularly marked inasmuch as resolution is reduced due to enlarged dots in the formed image, making it difficult to obtain the reproduction of excellent images having uniform density without density irregularity.

Rendering the particles smaller and providing a low magnetic force of the carrier is linked to the reduction of the attraction force of the carrier toward the sleeve, and lowered resistance is linked to inducing on the carrier a load of the opposite polarity of the latent image. Adhesion of the carrier to the image arises from the aforesaid causes. When carrier adheres to an image, toner around the carrier is inadequately transferred which leads to nonprinting white spots during developing. Furthermore, carrier adhesions cause black spot noise on the nonimage areas. Since the carrier is hard, the photosensitive member may be damaged during cleaning. Such damage reduces the surface potential due to the thinner layer of the damaged area, and leads to white-streak image noise. Furthermore, toner accumulates in the aforesaid defects so as to form spots which dissipate the charge when exposed to light and cause black spot image noise.

Among developing methods using the aforesaid two-component developers, developing methods are known which apply an AC electric field between a developing sleeve and an image-bearing member, the object of which is to improve the density of the area image. However, when such an AC electric field is applied, the latent image edge effect is enhanced, and line image reproducibility is lost. When an oscillating field is applied, carrier is dispersed from the developing sleeve, and adheres to the image-bearing member, causing the disadvantage of so-called carrier adhesion. In general, the absolute amount of developer containing toner, i.e., the amount of transported developer, is regulated (minimized) to prevent carrier adhesion during developing. However, when the amount of transported developer is small, the amount of toner available for developing is also small. Thus, the reproducibility of line images increasingly deteriorates even as carrier adhesion is reduced.

Furthermore, when developing is accomplished by bringing developer into contact with an image-bearing member while in a magnetic brush state, toner supplied to the image-bearing member is scraped by the magnetic brush on the developer transporting member which causes disturbance of the toner image formed on said image-bearing member. Particularly when a plurality of color toner are sequentially supplied to an image-bearing member to accomplish multicolor developing, the toner image is disrupted due to the scraping contact with the magnetic brush, thereby causing mixing of the color toners which precludes producing a multicolor image having accurate coloration.

Thus, in conventional methods a carrier having a low magnetic force is used in the developer, so as to soften the magnetic brush which comes into contact with the image-bearing member to control the disturbance of the toner image through said contact with the magnetic brush.

However, when a carrier having low magnetic force is used, the binding power of the carrier is weakened, such that the carrier readily separates from the developer transporting member and adheres to the image-bearing member. Such excessive carrier adhesion to the image-bearing member is particularly prevalent when developing input images such as high frequency images having ladder patterns, and images such as kanji patterns and the like which have a high number of images. Further disadvantages arise when carrier adheres to the image-bearing member, inasmuch as this carrier is transferred onto the transfer sheet together with the toner image, thereby causing carrier-induced white spots in the formed image, and the adhered carrier may damage the image-bearing member to the point of causing streak-like noise and spot-like noise in the developed image.

In recent years, methods have been proposed to prevent disturbance of a toner image formed on an image-bearing member by the magnetic brush of the developer, such as those disclosed in Japanese Unexamined Patent Application Nos. SHO61-32858 and SHO62-182760, wherein the developer on the developer transporting member does not come into contact with the image-bearing member when the developer is transported to the developing region opposite the image-bearing member via the developer transporting member by controlling the amount of developer on a developer transporting member so as to achieve a thin layer of developer on the developer transporting member, and in said state an oscillating electric field is applied to the developing region so as to supply the toner in the developer from the developer transporting member to the image-bearing member to develop the image.

However, when the amount of developer on the developer transporting member is regulated to a thin layer by a regulating member, as shown in FIG. 3, developer 1 flocculates on developer transporting member 11, such that a uniform thin layer of developer 1 cannot be formed on developer transporting member 11 and leads to dispersion of the amount of developer 1 on developer transporting member 11. In this state, when toner in the developer is supplied to the image-bearing member for developing via the action of an oscillating electric field in the developing region as previously described, irregular density is produced in the formed image, particularly in halftone images, such that images having uniformly fine texture cannot be obtained, and carrier adheres to the image-bearing member.

SUMMARY AND OBJECTS

High quality images can be obtained if carrier does not adhere to the photosensitive member. Carrier adhesion can be counteracted by reducing the thickness of the developer layer. This adhesion is caused by carrier having the opposite charge being adhered to the photosensitive member via the opposite electric field for developing. If the developer layer is made thinner, the charge is readily dissipated, and an electrical attraction force is not received relative to the photosensitive member. Specifically, the present inventors have discovered that this effect can be achieved by setting the amount of developer transported within a range of 0.7~5.0 mg/cm$^2$. Furthermore, reduction of developing capability due to white spots and streaks caused by scraping of the toner with the carrier can be avoided by reducing the contact force of the carrier.

An object of the present invention is to eliminate the previously described disadvantages which occur when a developer comprising a toner and a carrier is transported on a developer transporting member to a developing region opposite an image-bearing member, and toner in said developer is supplied from the developer transporting member to an image-bearing member in the developing region to accomplish development.

That is, the present invention provides a developing method wherein the various disadvantages which occur when toner in the developer is supplied from the developer transporting member to the image-bearing member in the developing region to accomplish developing, and the toner supplied to the image-bearing member is scraped by the magnetic brush of developer on the developer transporting member causing disruption of the toner image formed on the image-bearing member, adhesion of carrier on the image-bearing member, carrier-induced white spots in the formed image, damage to the image-bearing member by adhered carrier, and streak-like noise and spot-like noise in the formed image do not occur. Furthermore, irregularity of images formed by the edge effect on the edges of the electrostatic latent image formed on the image-bearing member do not occur, and resolution is not reduced by enlarged dots of the formed image, such that excellent high resolution images are obtained.

The present invention also provides a developing method for supplying developer from a developer transporting member to an image-bearing member in the developing region to accomplish developing, which provides excellent fine line reproducibility without producing streak-like noise or spot-like noise in formed images due to carrier adhesion on the image-bearing member, and which stably produces excellent images without toner airborne dispersion when toner in the developer is supplied to the image-bearing member.

A developing method of the present invention for developing an electrostatic latent image at a developing region includes preparing a developer containing toner particles and carrier particles which has an inherent resistance value of $1\times10^7$~$1\times10^{12}$ Ω·cm under an electric field of 500V/mm, magnetic force of 600~2300 G, and a mean particle size of 10–30 μm; regulating a quantity of the prepared developer on a developer transporter within a range of 0.7~5.0 mg/cm$^2$; transporting the regulated developer to the developing region; and applying an alternating current voltage between the developing region and the electrostatic latent image to generate an oscillating electric field therebetween in order to supply the transported developer to the electrostatic latent image.

Another developing method of the present invention for developing an electrostatic latent image at a developing region includes preparing a developer containing toner particles and carrier particles; regulating a quantity of the prepared developer on a developer transporter within a range of 0.7–5.0 mg/cm$^2$; transporting the regulated developer to the developing region; and applying an alternating current voltage between the developing region and the electrostatic latent image to generate an oscillating electric field to supply the transported developer to the electrostatic latent image wherein the oscillating electric field is expressed by the following formula:

$$5\ kV/mm \geqq (Vp\text{-}p/Ds) \geqq 3.5\ kV/mm$$

wherein the Vp-p is peak-to-peak value of the applied alternating current voltage, and Ds is a distance between the developing region and the electrostatic latent image.

Another developing method of the present invention for developing an electrostatic latent image at a developing region includes preparing a developer containing toner particles and carrier particles which has a bulk-compensated specific gravity of 0.28~0.37 and an angle of repose of 38°~52°; regulating a quantity of the prepared developer on a developer transporter within a range of 0.7~5.0 mg/cm$^2$; transporting the regulated developer to the developing region; and applying an electric field between the developing region and the electrostatic latent image to supply the transported developer to the electrostatic latent image.

DETAILED DESCRIPTION OF THE PREFERRED EMBODIMENTS

Figure 1:
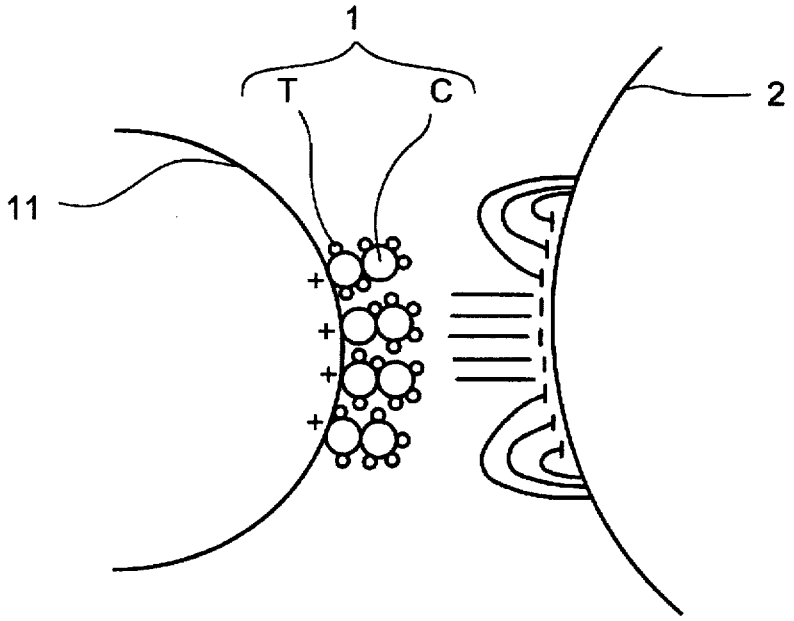
FIG. 1 shows the lines of electric force from the latent image portion of the image-bearing member when developing using a developer containing a high resistance carrier.

According to one embodiment of the present invention, these objects are achieved by providing a developing method which transports a developer comprising a toner and a carrier to a developing region opposite an image-bearing member via a developer transporting member, and toner in the developer is supplied from the developer transporting member to the image-bearing member in the developing region via the action of an oscillating field in the developing region to accomplish development, wherein the amount of developer transported on said developer transporting member to the developing region is regulated within a range of 0.7~5.0 mg/cm$^2$, and the carrier in the developer has an inherent resistance value of $1\times10^7$~$1\times10^{12}$ Ω·cm under an electric field of 500 V/mm, magnetic force is 600~2300 G, and a mean particle size of 10~30 μm.

In the developing method of one embodiment of the present invention, the amount of developer transported to the developing region by the developer transporting member is preferably regulated to a range of 0.7~5.0 mg/cm$^2$. When the amount of transported developer is less than 0.7 mg/cm$^2$, insufficient toner is supplied to the image-bearing member, and images having adequate image density of 1.3 or greater cannot be obtained. When the amount of transported developer is greater than 5.0 mg/cm$^2$, the developer layer transported by the developer transporting member becomes thicker, such that when the toner in the developer is supplied to the image-bearing member in the developing region to develop the latent image, the movement of the residual charge remaining on the carrier deteriorates after said toner is supplied and a significant countercharge remains on the carrier and causes the carrier to adhere to the image-bearing member, and more toner is subject to airborne dispersion rather than being supplied to the image-bearing member.

According to one embodiment of the present invention, these objects are achieved by providing a developing method which transports a developer comprising a toner and a carrier on a developer transporting member to a developing region opposite an image-bearing member, supplies toner in the developer from said developer transporting member to said image-bearing member via the action of an oscillating field in the developing region to accomplish development, wherein the amount of developer transported on said developer transporting member to the developing region is regulated within a range of 0.7~5.0 mg/cm$^2$, and the oscillating field (Vp-p/Ds) is expressed by the Equation 1 below when the gap between the developer transporting member and image-bearing member in the developing region is designated Ds, and the peak-to-peak value of the applied AC voltage is designated Vp-p.

$$5\ kV/mm \geqq Vp\text{-}p/Ds \geqq 3.5\ kV/mm \quad (1)$$

In the developing method of the present invention, if the previously described conditions are adequately satisfied, developing can be achieved whether or not developer transported by the developer transporting member comes into actual contact with the image-bearing member.

Furthermore, in the developing method of the present invention, toner concentration Tc in the developer is desirably set within a range of 10~25 percent-by-weight to suppress airborne toner dispersion during developing and to produce images of sufficient image density of 1.3 or higher.

Toner in the developer moving in the same direction as the developer transporting member and image-bearing member in the developing region is supplied to said image-bearing member to accomplish developing. When the moving speed V1 of the developer transporting member is much faster than the moving speed V2 of the image-bearing member, toner at the edge of the toner image in the movement direction formed on the image-bearing member is scraped by the magnetic brush of developer on the developer transporting member and becomes blurred, causing so-called trailing edge blurring. When the movement speed V1 of the developer transporting member is too slow, the amount of developer delivered to the image-bearing member from the developer transporting member is reduced, thereby providing insufficient toner from the developer transporting member to the image-bearing member and producing images having inadequate image density. Thus, the ratio θ (=V1/V2) of the speeds of the developer transporting member and image-bearing member are desirably set within a range of 1~3.

In order to comprehensively determine the amount of developer transported by the developer transporting member, the toner concentration Tc in the developer containing a toner and carrier, and the ratio θ of the speeds of the developer transporting member and image-bearing member so as to obtain images having sufficient image density, it is desirable that the conditions of Equation 2 below are satisfied.

$$(\text{Amt. dev. transport})\times\theta\times(Tc/100) \geqq 0.5\ mg/cm^2 \quad (2)$$

Figure 3:
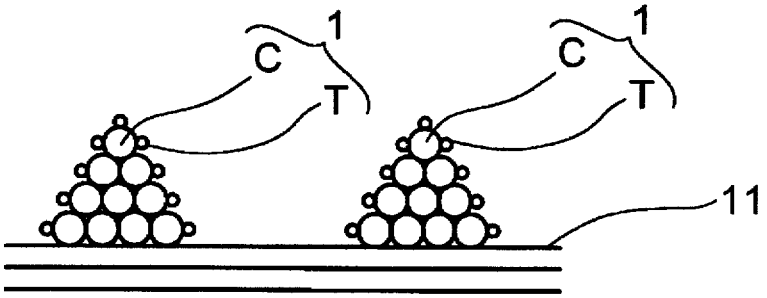
FIG. 3 shows developer flocculation occurring on a developer transporting member when using a carrier having a large magnetic force and a carrier having a large particle size.

When realizing the developing method of the present invention, if the carrier used in the developer has excessively strong magnetic force, the carrier partially flocculates as shown in FIG. 3, causing irregularity in the amount of developer 1 on developer transporting member 11, which leads to density irregularities in the formed images that precludes uniform fine textured development. Thus, it is desirable that carriers having a mean magnetic force of $9.0\times10^{-8}$ G·cm$^3$ or less per unit are used. When carriers having a mean magnetic force of $9.0\times10^{-8}$ G·cm$^3$ or less per unit are used, the aforesaid flocculation of the carrier does not occur, and developer 1 is uniformly distributed upon developer transporting member 11 so as to provide uniform fine texture development without density irregularities.

When the present inventors combined the application of an AC electric field and minimalization of the amount of transported developer to inhibit deterioration of line reproducibility with the AC field of a specific field intensity and minimalization of the amount of transported developer of specific range, the unique result of contrarily improved line reproducibility was obtained.

Thus, although the reasons for obtaining contrary results are not necessarily clear based on current knowledge of the art, the present inventors have considered the following possible explanations. That is, line reproducibility is thought to result from efficient transport of developer to the developing region and participation of said developer in development. The application of an AC electric field reduces the charging of the carrier with a polarity opposite of its original charge, i.e., reduces countercharging of the carrier, such that developing efficiency is improved. However, when carrier is present in excess of the amount required, there is inadequate reduction of countercharging, while conversely dispersion occurs if too little carrier is present. Furthermore, even if the carrier and toner are present in suitable amounts, carrier dispersion or charge leakage occurs when the AC field is too strong, or there is no reduction in countercharging at all if the AC field is too weak. Thus, the participation of developer transported to the developing region increases only when an AC field of suitable field intensity is combined with the transport of a suitable amount of developer. The logical result of such combination is improved line reproducibility.

One embodiment of the present invention achieves these objects by providing a developing method which supplies a developer comprising a toner and a carrier on a developer transporting member, regulates the amount of developer on said developer transporting member via a regulating member, and transports said developer on said developer transporting member to a developing region opposite a latent image-bearing member, wherein the amount of developer transported on said developer transporting member to the developing region is regulated within a range of 0.7~5.0 mg/cm2, and the developer used has a bulk-compensated specific gravity of 0.28~0.37, and an angle of repose of 30°~60°, and more preferably 38°~52°.

When a developer is used wherein the value of the bulk-compensated specific gravity exceeds 0.37, developer flocculation becomes conspicuous when the amount of transported developer is regulated to 0.7~5.0 mg/cm$^2$. That is, as shown in FIG. 3, developer 1 on developer transporting member 11 flocculates and causes unevenness of developer 1 on developer transporting member 11, which leads to marked density irregularity and the like in the formed image and particularly halftone images because the amount of transported developer, i.e., 0.7~5.0 mg/cm$^2$, is extremely slight, such that uniformly fine textured images cannot be obtained.

On the other hand, when a developer is used wherein the bulk-compensated specific gravity value is less than 0.28, various problems occur including inadequate charging of the toner in the developer due to extreme deterioration of the developer flow characteristics. The bulk-compensated specific gravity expresses packing of particles per unit area, and is represented by the equation (bulk-compensated specific gravity=bulk specific gravity/true specific gravity). The method used to determine the bulk-compensated specific gravity of the developer of the present invention is stipulated in JIS K5101, which defines bulk-compensated specific gravity as a value obtained by measuring the apparent density (bulk specific gravity) of the developer, and dividing said measured apparent density (bulk specific gravity) of the developer by the true specific gravity of the developer.

Figure 9:
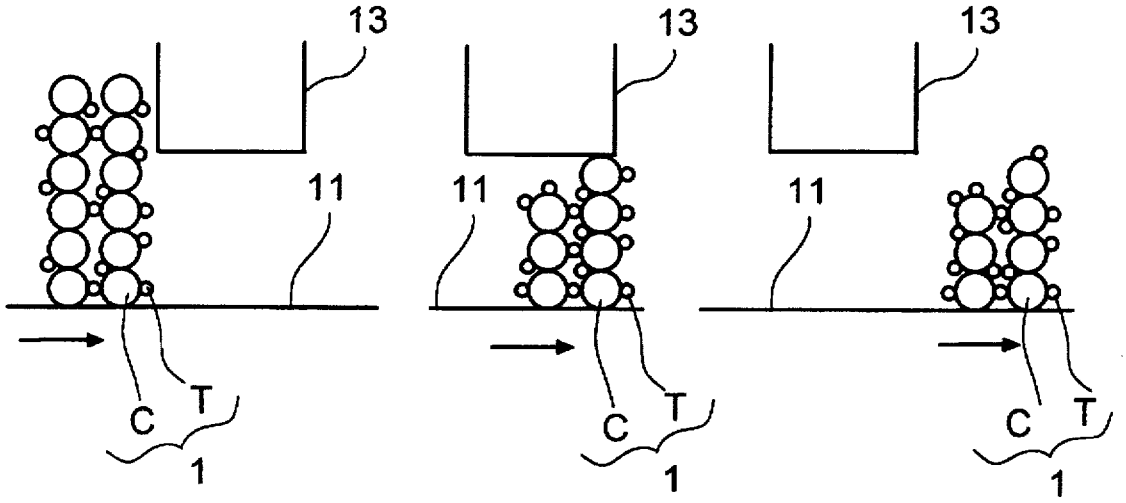
FIG. 9 shows irregularities in developer layer thickness on the developer transporting member when a developer is used which has a small angle of repose and the amount of developer on the developer transporting member is regulated by a regulating member.

When a developer is used which has a small angle of repose, for example, less than 30° or 38°, the force exerted among the developer is weakened, and when the amount of transported developer is within the range of 0.7~5.0 mg/cm$^2$, e.g., when the amount of developer 1 on developer transporting member 11 is regulated by regulating member 13 as shown in FIG. 9, the magnetic brush formed by developer 1 is simply regulated from a position, such that irregularities occur in the thickness of the layer of developer 1 on developer transporting member 11.

Figure 10:
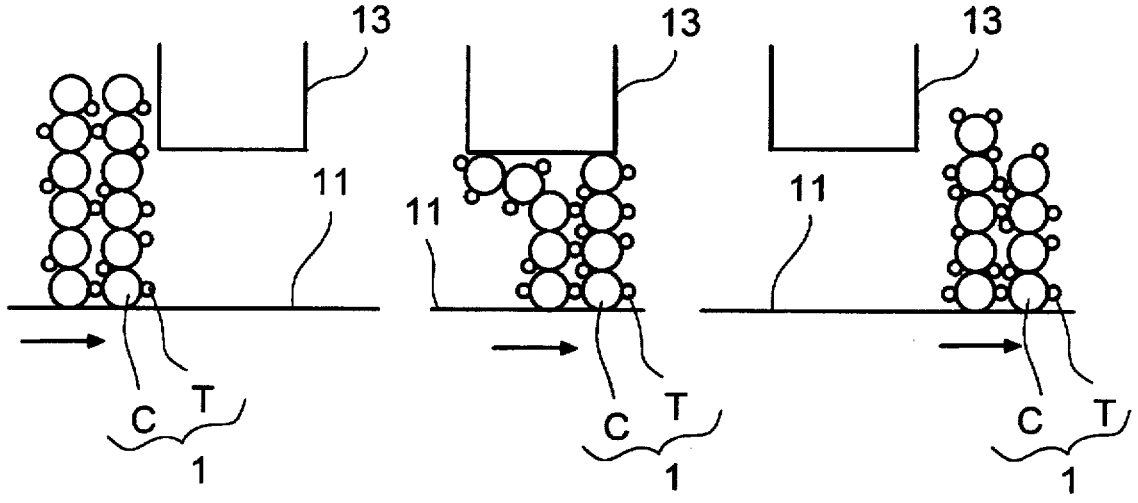
FIG. 10 shows irregularities in developer layer thickness on the developer transporting member when a developer is used which has a large angle of repose and the amount of developer on the developer transporting member is regulated by a regulating member.

On the other hand, when a developer is used which has a large angle of repose, for example, that exceeds 52° or 60°, the force exerted among the developer is excessively strengthened and the magnetic brush formed by the developer is becomes difficult to regulate. For example, when the amount of developer 1 on developer transporting member 11 is regulated by regulating member 13 as shown in FIG. 10, part of the magnetic brush formed by developer 1 passes intact and is not cut by regulating member 13, such that more developer 1 remains on parts of developer transporting member 11, such that irregularities occur in the thickness of the layer of developer 1 on developer transporting member 11, just as in the previously described instance. The angle of repose of the developer of the present invention expresses a value measured using a powder tester manufactured by Hosokawa Micron, Ltd.

If the previously described conditions are adequately satisfied, developing can be achieved whether or not developer transported by the developer transporting member comes into actual contact with the image-bearing member. When developing is accomplished without developer coming into contact with the image-bearing member, disturbances and the like due to contact with the developer and the toner image formed on the image-bearing member are desirably suppressed to an even greater extent.

In an embodiment of the present invention, developer comprising a toner and a carrier is transported by a developer transporting member to a developing region opposite an image-bearing member, and toner contained in the developer is supplied from the developer transporting member to the image-bearing member to develop the latent image. Since the amount of developer transported to the developing region by the developer transporting member is preferably regulated within a range of 0.7~5.0 mg/cm$^2$, an amount of developer adequate for developing is delivered to the developing region, such that there is no insufficiency of toner when the toner in the developer is supplied from the developer transporting member to the image-bearing member, whereby images of suitable image density are obtained. Furthermore, since a thin layer of developer is transported by the developer transporting member, the charge remaining on the carrier flows to the developer transporting member when toner in the developer is supplied to the image-bearing member, thereby reducing the countercharge remaining on the carrier, which suppresses adhesion of the carrier to the image-bearing member and reduces airborne dispersion of toner during developing.

Figure 5:
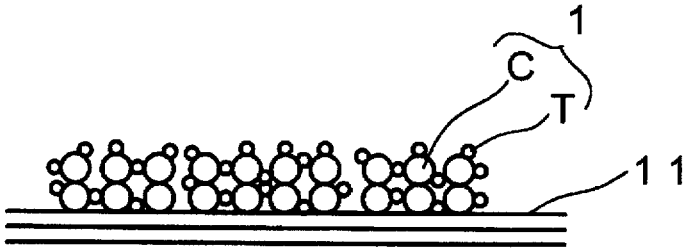
FIG. 5 shows the state of the developer when developer containing a carrier satisfying the conditions of the present invention is transported on a developer transporting member.

In an embodiment of the developing method of the present invention, since a developer is used which has a bulk-compensated specific gravity of 0.28~0.37 as previously described, developer flow characteristics do not markedly deteriorate, thereby allowing the toner in the developer to be adequately charged. Furthermore, developer 1 on developer transporting member 11 is not partially flocculated such that developer 1 is evenly distributed on developer transporting member 11 as shown in FIG. 5, thereby allowing the formation of a fine texture magnetic brush, such that finely textured images are obtainable without irregularities even in the case of halftone images.

Figure 11:
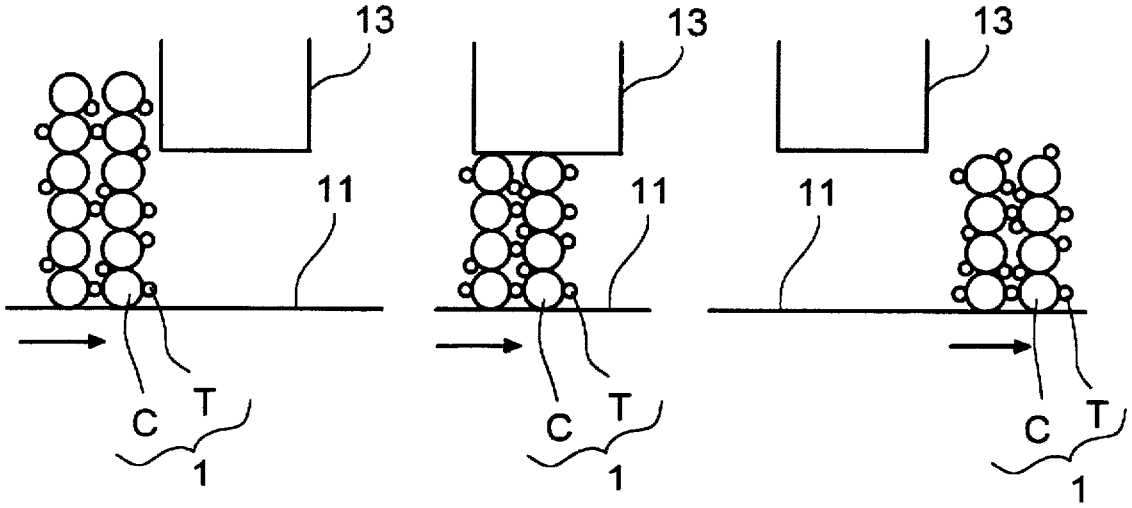
FIG. 11 shows the developing method of the present invention wherein a thin layer of developer is uniformly formed without irregularities on a developer transporting member when the amount of developer on the developer transporting member is regulated by a regulating member.

In an embodiment of the present invention, since a developer is used which has an angle of repose within a range of 30°~60°, or more specifically 38°~52°, the force exerted among the developer is neither excessively weak or excessively strong. Thus, when the amount of developer 1 on developer transporting member 11 is regulated as shown in FIG. 11, a uniform thin layer of developer 1 without irregularities is formed on developer transporting member 11, thereby preventing density irregularities in the obtained image.

Figure 6:
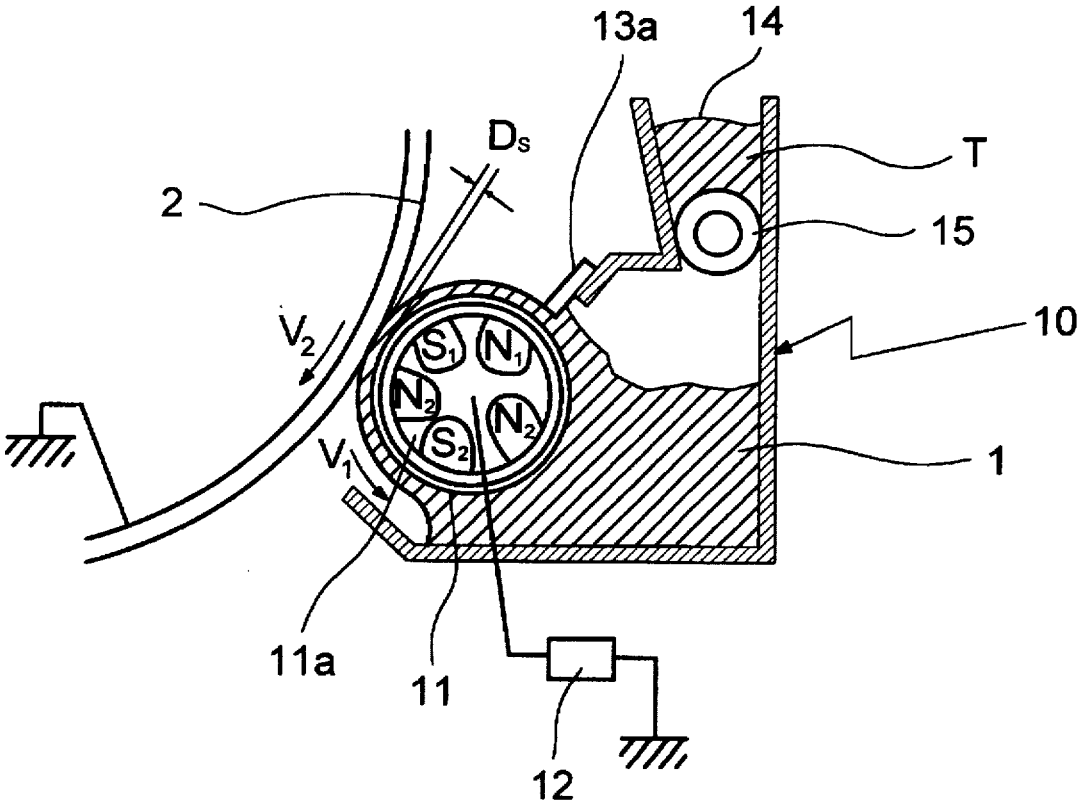
FIG. 6 shows a developing device using the developing method of the present invention.

FIG. 6 shows an example of a developing device 10 using an embodiment of the developing method of the present invention.

Developer 1 comprising toner T and carrier C is accommodated in the developing device 10. Cylindrical developing sleeve 11 provided with a built in magnet roller 11*a* having a plurality of magnetic poles N1, S1, N2, S2, N3 is used as the developer transporting device for transporting developer 1. Developing sleeve 11 is rotatably supported in the developing region so as to confront photosensitive member 2, i.e., image-bearing member 2, through a suitable spacing Ds.

Developing sleeve 11 is rotated in the opposite direction to the rotation of photosensitive member 2, i.e., developing sleeve 11 and photosensitive member 2 move in the same direction in the developing region wherein developing sleeve 11 confronts photosensitive member 2. Thus, developer 1 accommodated in developing device 10 is transported to photosensitive member 2 in accordance with the rotation of said developing sleeve 11, said developer 1 being in a magnetic brush state via the action of the magnetic force exerted by the aforesaid magnet roller 11*a*.

Developing bias power source 12 is connected to developing sleeve 11, and applies a developing bias voltage comprising either an alternating current (AC) or a direct current (DC) overlaying an alternating current so as to produce an oscillating electric field in the developing region.

Regulating member 13, which includes a magnetic blade 13*a*, is provided at a position opposite magnetic pole N1 of magnetic roller 11*a* upstream in the developer transport direction from the developing region at which the developer transport member confronts photosensitive member 2 so as to have a desired spacing relative to developing sleeve 11. The amount of developer 1 on developing sleeve 11 is regulated by the magnetic blade 13*a*.

Toner container 14 which accommodates toner T is provided at the top of developing device 10. Toner T in developer 1 is supplied from developing sleeve 11 to photosensitive member 2 to accomplish developing. When the toner concentration in developer 1 within developing device 10 is reduced, toner replenishment roller 15 provided below said toner container 14 is rotated and resupplies toner T accommodated in toner container 14 to developer 1 within developing device 10.

In an embodiment of the developing method of the present invention, the carrier used in the developer preferably has an inherent resistance value of $1\times10^{7}$~$1\times10^{12}$ Ω·cm under an electric field of 500 V/mm. When the inherent resistance value is less than $1\times10^{7}$~$1\times10^{12}$ Ω·cm, carrier readily adheres to the image-bearing member when the toner in the developer is supplied from the developer transporting member to the image-bearing member via the action of the oscillating field in the developing region. On the other hand, when the inherent resistance value is greater than $1\times10^{7}$~$1\times10^{12}$ Ω·cm, the electrical resistance of the carrier is increased, causing electrical lines of force to circumscribe the edges of the electrostatic latent image formed on image-bearing member 2, thereby strengthening the electric field at said edges, such that toner T in developer 1 is abundantly supplied to said edges for strong development.

Figure 2:
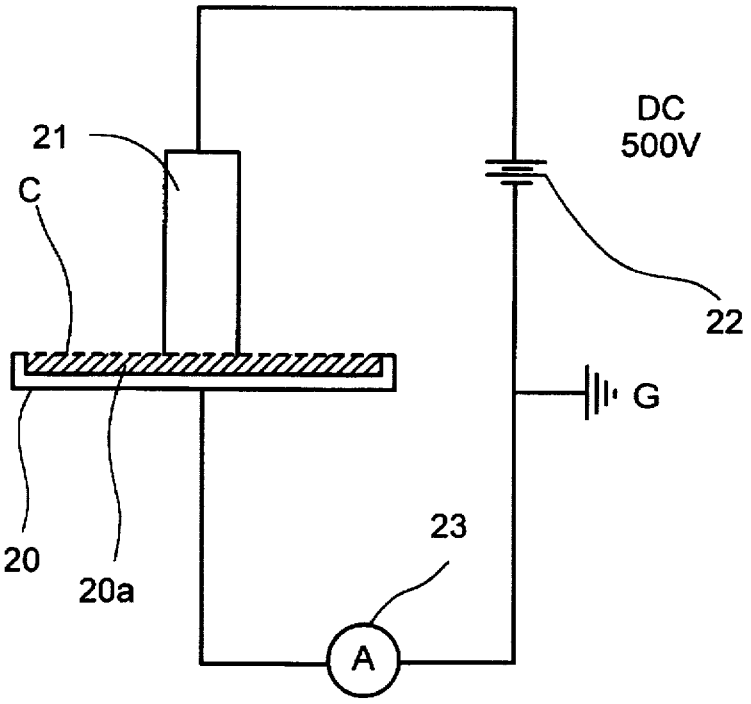
FIG. 2 briefly shows a device used to measure the inherent resistance value of a carrier used in a developer.

The inherent resistance value of the aforesaid carrier may be determined by accommodating carrier C in concavity 20*a* of blade 20 to a thickness of 1 mm, disposing a 20 mm diameter electrode 21 on the top surface of said carrier C, applying a voltage of 500 V from power source 22 and measuring the current that flows through the layer of carrier C via ammeter 23, as shown in FIG. 2.

The carrier used in developer 1 has a magnetic force of 600~2300 G, and mean particle size of 10~30 μm. When a carrier is used which has a magnetic force less than 600 G or mean particle size less than 10 μm, the carrier readily adheres to the image-bearing member. When carrier having a magnetic force in excess of 2300 G, or carrier having a mean particle size greater than 30 μm are used, carrier C flocculates causing irregular thickness of the developer layer on developer transporting member 11, which leads to irregular density in the formed image and prevents uniformly fine textured images from being developed. The magnetic force of the carrier is expressed as a value measured using a 1 k Öe magnetic field using a DC magnification autorecording device (Hosokawa Denki K.K.). Carrier particle size is expressed as a value measured by a coulter counter (Coulter, Inc.).

In the developing method of the present invention, if the previously described conditions are adequately satisfied, developing can be achieved whether or not developer transported by the developer transporting member comes into actual contact with the image-bearing member. When developing is accomplished without developer coming into contact with the image-bearing member, disturbances and the like due to contact with the developer and the toner image formed on the image-bearing member are desirably suppressed to an even greater extent.

In an embodiment of the present invention, developer comprising a toner and a carrier is transported by a developer transporting member to a developing region opposite an image-bearing member, and toner contained in the developer is supplied from the developer transporting member to the image-bearing member via the action of an oscillating field in the developing region to develop the latent image. Since the amount of developer transported to the developing region by the developer transporting member is regulated within a range of 0.7~5.0 mg/cm$^2$, an amount of developer adequate for developing is delivered to the developing region, such that there is no insufficiency of toner when the toner in the developer is supplied from the developer transporting member to the image-bearing member, whereby images of suitable image density are obtained. Furthermore, since a thin layer of developer is transported by the developer transporting member, the charge remaining on the carrier flows to the developer transporting member when toner in the developer is supplied to the image-bearing member, thereby reducing the countercharge remaining on the carrier, which suppresses adhesion of the carrier to the image-bearing member and reduces airborne dispersion of toner during developing.

Figure 4:
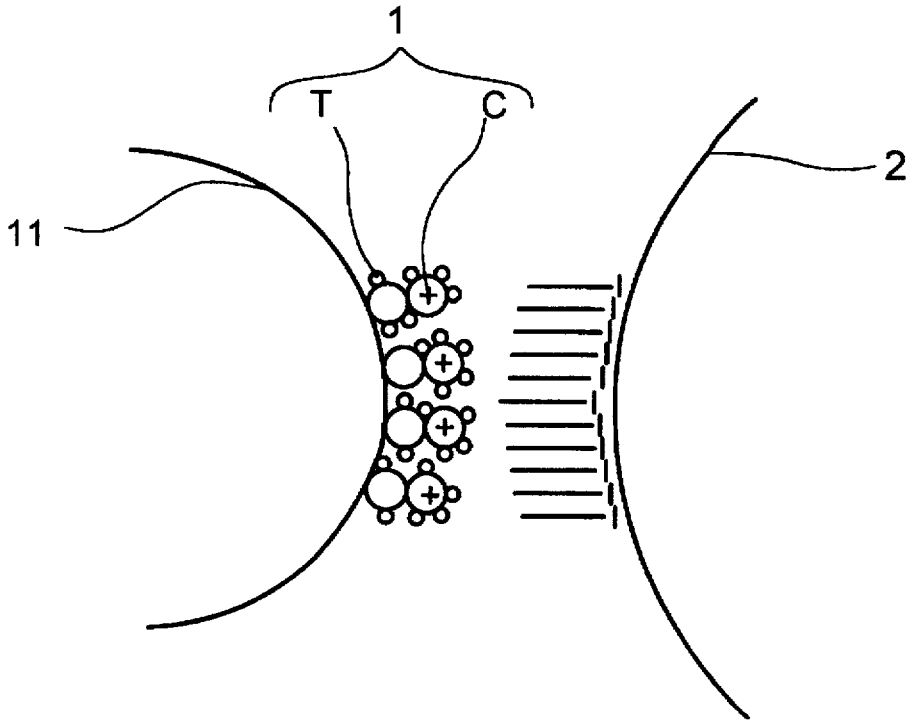
FIG. 4 shows the lines of electric force from the latent image portion of the image-bearing member when developing using a developer containing a low resistance carrier.

In an embodiment of the developing method of the present invention, since a carrier is used which has an inherent resistance value of $1\times10^7$~$1\times10^{12}$ Ω·cm under an electric field of 500 V/mm, when toner T in developer 1 on developer transporting member 11 is supplied to image-bearing member 2 in the developing region opposite said image-bearing member 2, as shown in FIG. 4, a load is induced in accordance with the change in the field at the tip of carrier C opposite the image-bearing member 2, such that the actual development electric field is enlarged even is the gap Ds is increased between developer transporting device 11 and image-bearing member 2 opposite the developing region. Thus, images having sufficient density are obtainable even when the amount of developer 1 transported by developer transporting member 11 is within a small range, and the lines of electric force from the latent image on image-bearing member 2 as well as the lines of electric force circumscribing the edges of the latent image are suppressed, thereby inhibiting pronounced edge effect in the developed image.

In an embodiment of the developing method of the present invention, the carrier used in the developer has a magnetic force of 600~2300 G, and a mean particle size of 10~30 μm, flocculation of developer 1 as shown in FIG. 3 does not occur, and a uniform layer of developer is formed on developer transporting member 11, as shown in FIG. 5, even when the amount of developer transported to the developing region on developer transporting member 11 is within the previously described small range. When developing is accomplished in the aforesaid state, excellent fine texture image of high resolution are obtained without density irregularities, and adhesion of carrier C on image-bearing member 2 is suppressed.

The developing method of one embodiment of the present invention is realized using the aforesaid developing device 10, and the carrier used in the developer preferably has an inherent resistance value of $1\times10^7$~$1\times10^{12}$ Ω·cm under an electric field of 500 V/mm, magnetic force is 600~2300 G, and a mean particle size of 10~30 μm. The amount of developer 1 transported via the rotating developing sleeve 11 to the developing region opposite photosensitive member 2 is regulated by the aforesaid magnetic blade 13, such that the amount of developer 1 transported by developing sleeve 11 is regulated within an optionally determined range.

After the amount of developer 1 on developing sleeve 11 is regulated, said developer 1 is delivered to the developing region opposite photosensitive member 2 by developing sleeve 11. A developing bias voltage is supplied from developing bias power source 12, and the toner T in developer 1 transported by developing sleeve 11 is supplied from developing sleeve 11 to the electrostatic latent image formed on photosensitive member 2 via the action of the oscillating field in the developing region to accomplish developing.

When developing is accomplished as described above, sufficient toner T is supplied from developing sleeve 11 to the latent image on photosensitive member 2, such that a uniformly thin layer of developer 1 is formed on developing sleeve 11 and developing is accomplished without strong development of only the edges of the latent image on photosensitive member 2. Thus, high resolution images are obtained which have uniformly fine texture and excellent image density without density irregularities. Furthermore, adhesion of carrier on photosensitive member 2 does not occur, thereby avoiding damage to photosensitive member 2 by the adhered carrier and the resulting carrier-induced whiteouts in the formed image. Airborne dispersion of toner T is also avoided, thereby preventing fogging of the obtained image, as well as soiling of the interior of the device.

Experiments were conducted on various carriers used in the developer used in developing device 10. It is clearly desirable that carriers satisfying the conditions of the present invention are used.

Experiment 1

In this experiment, magnetic powder (RB-BL; Titanium K.K.) and carbon black were added to styrene-acrylic resin (Mn=15000, Mw=200,000, Ti=100° C.) in the proportions listed in Table 1. These materials were mixed using a Henschel mixer, and kneaded in a continuous extrusion device. After cooling, the material was subjected to coarse classification, then fine classification to obtain a mean particle size of 16 μm. This material was then classified by a forced air classifier to produce carriers 1~6 having a mean particle size of 20 μm.

The respective inherent resistance value (Ω·cm) of each carrier 1~6 was determined, and the magnetic force of each carrier was measured under a 1 kÖe magnetic field using a DC magnetization autorecording device (model 3257; Hosokawa Denki K.K.). The results are shown in Table 1

TABLE 1

| Carrier | Resin (pbw) | Magnetic powder (pbw) | CB (pbw) | Inherent resistance (Ω/cm) | Magnetic force (G) |
|---|---|---|---|---|---|
| 1 | 100 | 200 | 4 | $3\times10^{14}$ | 1050 |
| 2 | 100 | 200 | 10 | $1\times10^{12}$ | 1050 |
| 3 | 100 | 200 | 15 | $1\times10^{10}$ | 1050 |
| 4 | 100 | 200 | 30 | $5\times10^{8}$ | 1050 |
| 5 | 100 | 200 | 35 | $3\times10^{7}$ | 1050 |
| 6 | 100 | 200 | 40 | $4\times10^{6}$ | 1050 |

*pbw = parts-by-weight

These results clearly show that among carriers 1~6, carriers 2~5 satisfy the conditions of the present invention. Carrier 1 has an inherent resistance which exceeds the upper limit of the condition of the present invention, and carrier 6 has an inherent resistance too low.

On the other hand, the toner mixed with carriers 1~6 was produced by adding 3 pbw nigrosine charge control agent, 6 pbw carbon black, and 2.5 pbw low molecular weight polypropylene to 100 pbw styrene-acrylic resin (Mn=15,000, Mw=200,000) to obtain a toner having a mean particle diameter of about 8 μm.

The aforesaid toner was added to each of the carriers 1~6 to obtain developer having a toner concentration of 15 percent-by-weight which were used in developing device 10 to accomplish developing.

Developing of images using the aforesaid developers was accomplished with the image forming speed of developing device 10 set at 40 cpm, spacing between developing sleeve 11 and magnetic blade 13 set at 0.3 mm, and the amount of developer transported to the developing region via developing sleeve 11 regulated at 4.0 mg/cm$^2$. The gap Ds between developing sleeve 11 and photosensitive member 2 in the developing region was set at 0.3 mm, and the initial surface potential $V_0$ of photosensitive member 2 was adjusted variously as shown in Table 2. A bias voltage comprising 150 V DC bias voltage from developing bias power source 12, and an overlaid AC bias voltage having a peak-to-peak value Vp-p as shown in Table 2 at a frequency of 2,000 Hz was applied to produce an oscillating field in the developing region.

Developing was accomplished using the developers containing the aforesaid carriers 1~6, and the resolution and edge uniformity (edge characteristics) of the obtained images, as well as carrier adhesion on photosensitive member 2 (carrier adhesion) were evaluated. The evaluation results are shown in Table 2. Resolution, edge characteristics, and carrier adhesion were evaluated in the following rankings: excellent was indicated by the symbol ⊙, good was indicated by the symbol ○, some deficiency was indicated by the symbol Δ, and poor was indicated by the symbol X.

TABLE 2

| | Carrier | | | | | |
|---|---|---|---|---|---|---|
| | 1 | 2 | 3 | 4 | 5 | 6 |
| V (V) | −650 | −500 | −420 | −360 | −330 | −310 |
| $V_{P-P}$ (V) | 2000 | 1500 | 1000 | 850 | 700 | 700 |
| Resolution | X | ○ | ○ | ⊙ | ⊙ | ⊙ |
| Edge | X | ○ | ○ | ⊙ | ⊙ | ⊙ |
| Carrier adhesion | ○ | ○ | ⊙ | ⊙ | ○ | X |

As can be understood from the data of Table 2, when developers were used which contained carriers 2~5 that satisfied the conditions of the present invention, superior images with excellent edge characteristics and resolution were obtained without toner breakdown of the lines of the formed image. There was also no carrier adhesion on photosensitive member 2.

In contrast, when the developer containing high resistance carrier 1 was used which had an inherent resistance value of $3\times10^{14}$ Ω·cm which exceeds the limit of $1\times10^{12}$ Ω·cm, edge effect increased causing toner breakdown of the lines of the formed image, and resolution and edge characteristics in the image deteriorated. Furthermore it was necessary to apply an extremely high voltage of 2,000 V for the AC voltage having peak-to-peak value Vp-p applied from developing bias power source 12, which caused a leak between the developing sleeve 11 and the photosensitive member 2.

On the other hand, when the developer containing low resistance carrier 6 was used which had an inherent resistance value of $4\times10^{6}$ Ω·cm which is below the lower limit of $1\times10^{7}$ Ω·cm, good resolution and edge characteristics were obtained in the formed image, but excessive carrier adhered to photosensitive member 2 causing carrier-induced damage to said photosensitive member 2.

Experiment 2

In this experiment, carrier was manufactured in the same way as the first experiment with the exception that the magnetic powder alone was changed. The magnetic powder used was a ferrite powder having saturation magnetization ( óm) of 66 emu, coercive force (Hc) of 120 Öe, and particle diameter of 0.6 μm. To 100 pbw of the aforesaid styrene-acrylic resin were added 520 pbw of said ferrite powder in carrier 7, and 700 pbw of said ferrite powder in carrier 8. To these respective carriers were added 10 pbw carbon black. In all other respects the carriers were produced in the same manner as in experiment 1 to obtain carriers 7 and 8 having a mean particle size of 20 μm.

In the present experiment, the constituents of carrier 2 of experiment 1 were used to produce carrier 9 having a mean particle size of 5 μm, and carrier 10 having a mean particle size of 10 μm. The constituents of carrier 7 were used to produce carrier 11 having a mean particle size of 30 μm, and carrier 12 having a mean particle size of 45 μm.

The inherent resistance value (Ω·cm) and magnetic force (G) of carriers 7~12 were measured in the same way as described in experiment 1. The measurement results are shown in Table 3 in combination with mean particle size (μm). The amount of transported developer was set at 40 mg/cm$^2$, just as in experiment 1.

TABLE 3

| Carrier | Inherent resistance (Ω/cm) | Magnetic force (G) | Mean particle size (μm) |
|---|---|---|---|
| 7 | $3\times10^{11}$ | 2300 | 20 |
| 8 | $7\times10^{10}$ | 2570 | 20 |
| 9 | $5\times10^{11}$ | 1050 | 5 |
| 10 | $2\times10^{11}$ | 1050 | 10 |
| 11 | $1\times10^{11}$ | 2300 | 30 |
| 12 | $3\times10^{10}$ | 2300 | 45 |

The results show that among carriers 7~12, carriers 7, 10, and 11 satisfy the conditions of the present invention. Carrier 8 had a magnetic force which was higher than the condition of the present invention, carrier 9 had a mean particle size smaller than the condition of the present invention, and carrier 12 had a mean particle size larger than the condition of the present invention.

When developing was accomplished using carriers 7~12 in the same manner as described in experiment 1, uniformity of developer on the developing sleeve 11, image texture, and carrier adhesion on photosensitive member 2 were evaluated. The evaluation results are shown in Table 4.

Uniformity, texture, and carrier adhesion were evaluated in the same manner as shown in Table 2, i.e., excellent was indicated by the symbol ⊙, good was indicated by the symbol ○, some deficiency was indicated by the symbol Δ, and poor was indicated by the symbol X.

TABLE 4

| | Carrier | | | | | |
|---|---|---|---|---|---|---|
| | 7 | 8 | 9 | 10 | 11 | 12 |
| Uniformity | ○ | Δ~X | ⊙ | ⊙ | ○ | X |
| Texture | ○ | X | ⊙ | ⊙ | ○ | X |
| Carrier adhesion | ⊙ | ⊙ | X | ○ | ○ | ○ |

When developers were used which contained carriers 7, 10, and 11 that satisfied the conditions of the present invention, there was no flocculation of developer 1 on developing sleeve 11. As shown in FIG. 5, a uniform thin layer of developer 1 was formed on developing sleeve 11 without density irregularities, such that finely textured high resolution images were obtained without carrier adhesion on photosensitive member 2.

Conversely, when developers were used which contained carrier 8 having a high magnetic force of 2570 G, and carrier 12 having a large mean particle size of 45 μm, there was flocculation of developer 1 on developing sleeve 11, as shown in FIG. 3, causing density irregularities in the formed image, such that finely textured images could not be obtained.

On the other hand, when developer was used which contained carrier 9 having a small mean particle size of 5 μm, finely textured images were obtained without density irregularities, but there was abundant carrier adhesion on photosensitive member 2 which caused carrier-induced damage to said photosensitive member 2.

Experiment 3

In this experiment, Zn-ferrite having the electrical resistance value, mean particle size, and magnetic force shown in Table 5 was used in carriers 13~20. Carriers 13~16 and 20 satisfied the conditions of the present invention.

Developing was accomplished in the same manner as described in experiment 1 using developers containing carriers 13~20. Uniformity of developer on developing sleeve 11, texture of the formed image, and carrier adhesion on photosensitive member 2 were evaluated. Evaluation results are shown in Table 5. Uniformity, texture, and carrier adhesion were evaluated in the same manner as described with reference to Table 4.

TABLE 5

| Carrier | Magnetic force (G) | Mean particle size (μm) | Resistance (Ω/cm) | Uniformity | Texture | Carrier adhesion |
|---|---|---|---|---|---|---|
| 13 | 2300 | 10 | $3 \times 10^{10}$ | ⊙ | ⊙ | ⊙ |
| 14 | 2300 | 20 | $3 \times 10^{10}$ | O | O | ⊙ |
| 15 | 2300 | 30 | $3 \times 10^{10}$ | O | O | ⊙ |
| 16 | 600 | 10 | $3 \times 10^{10}$ | ⊙ | ⊙ | O |
| 17 | 500 | 10 | $1 \times 10^{7}$ | ⊙ | ⊙ | X |
| 18 | 600 | 9 | $1 \times 10^{7}$ | ⊙ | ⊙ | X |
| 19 | 600 | 10 | $7 \times 10^{6}$ | ⊙ | ⊙ | X |
| 20 | 600 | 10 | $1 \times 10^{7}$ | ⊙ | ⊙ | O |

As can be understood from the above results, carriers used in the present invention are not limited to binder type carriers which use resins such as described in experiments 1–3. The ferrite carriers such as those of the present experiment may form a uniform thin layer of developer 1 on developing sleeve 11 without density irregularities, and produce uniformly fine textured high resolution images without carrier adhesion to the photosensitive member 2 in the same manner as binder type carriers which use resins and magnetic powder dispersed in the resins insofar as such ferrite carriers satisfy the conditions of the present invention.

Experiment 4

Developing device 10 and toner T were used in the same manner as described in experiment 1, in conjunction with each carrier shown in Table 6. The amount of transported developer was varied, and carrier adhesion and image density (ID) and the like were evaluated in the same manner as described in reference to Table 4.

Variation of the amount of transported developer was accomplished by widening or narrowing the spacing between developing sleeve 11 and magnetic blade 13. Evaluation results are shown in Table 6. As Table 6 clearly shows, carrier adhesion occurred when the amount of transported developer exceeded 5 mg/cm$^2$ (experiments III, IV, IX, and X). On the other hand, the obtained image density when the amount of transported developer was less than 0.7 mg/cm$^2$ was less than a desirable image density ID value of 1.3.

TABLE 6

| Ex. No. | Carrier type | Amount transported (mg/cm$^2$) | Carrier adhesion | ID | Texture | Resolution |
|---|---|---|---|---|---|---|
| I | 3 | 15 | XX | 1.4 | O | XX |
| II | 3 | 10 | X | 1.4 | O | Δ~X |
| III | 3 | 7 | Δ | 1.4 | O | O |
| IV | 3 | 5 | ⊙ | 1.4 | ⊙ | O |
| V | 3 | 3 | ⊙ | 1.35 | ⊙ | ⊙ |
| VI | 3 | 1 | ⊙ | 1.35 | ⊙ | ⊙ |
| VII | 3 | 0.7 | ⊙ | 1.3 | ⊙ | ⊙ |
| VIII | 3 | 0.5 | ⊙ | 1.1 | ⊙ | ⊙ |
| IX | 16 | 7 | X | 1.45 | O | O |
| X | 16 | 5 | O | 1.45 | ⊙ | ⊙ |
| XI | 20 | 5 | O | 1.45 | ⊙ | ⊙ |
| XII | 20 | 7 | X | 1.45 | O | O |

The evaluation standards for carrier adhesion and resolution in Table 6 are identical to those of Table 2, and ratings were indicated by the symbols ⊙~X. The evaluation standard for texture was identical to that of Table 4. Image density was measured using a MacBeth RDP20 (MacBeth, Inc.).

In an embodiment of the developing method of the present invention as described above, a developer comprising a toner and a carrier on a developer transporting member is transported to a developing region opposite an image-bearing member, and toner in the developer is supplied from said developer transporting member to said image-bearing member via the action of an oscillating field in the developing region to accomplish development. The amount of developer transported on said developer transporting member to the developing region is regulated within a range of 0.7~5.0 mg/cm$^2$, and the carrier used in the developer has an inherent resistance value of $1\times10^{7}$~$1\times10^{12}$ Ω·cm under an electric field of 500 V/mm, magnetic force is 600~2300 G, and a mean particle size of 10~30 μm. Therefore, toner insufficiency does not occur when toner is supplied to the image-bearing member for developing, and images with excellent image density are obtained because sufficient toner is supplied to the image-bearing member. Furthermore, airborne toner dispersion during developing is suppressed so that fogging of the image does not occur.

According to the developing method of the present invention, when toner in the developer is supplied to the image-bearing member in the developing region during developing, the lines of electric force circumscribing the edges of the latent image on the image-bearing member are suppressed, such that strong development of said edges does not occur. Furthermore, flocculation of the developer does not occur because the amount of developer transported to the developing region by the developer transporting member is regulated within a small range, and, therefore, developer is delivered to the developing region in a state of uniform distribution on the developer transporting member for use in developing, such that high resolution images of excellent texture and without density irregularities are obtained.

The developing method of the present invention further provides that when toner in a developer is supplied to an image-bearing member by the action of an oscillating field in the developing region wherein the developer transporting member and image-bearing member confront one another, carrier adhesion on the image-bearing member is suppressed, such that carrier-induced damage to the image bearing member, and resultant image noise are prevented, and excellent quality images are obtained.

According to another embodiment of the present invention using the aforesaid developing device 10, the amount of developer 1 transported via the rotating developing sleeve 11 to the developing region opposite the photosensitive member 2 is regulated by the aforesaid magnetic blade 13*a*, such that the amount of developer 1 transported by developing sleeve 11 is within a range of 0.7~5.0 mg/cm$^2$.

After the amount of developer 1 on developing sleeve 11 is regulated, said developer 1 is delivered to the developing region opposite photosensitive member 2 by developing sleeve 11. A developing bias voltage is supplied from developing bias power source 12, and the toner T in developer 1 transported by developing sleeve 11 is supplied from developing sleeve 11 to the electrostatic latent image formed on photosensitive member 2 via the action of the oscillating field in the developing region to accomplish developing.

The oscillating field in the developing region is accomplished by regulating the peak-to-peak value Vp-p of the AC voltage supplied as a bias voltage from the developing bias power source 12 at the gap Ds between developing sleeve 11 and photosensitive member 2. The oscillating field (Vp-p/Ds) acting between developing sleeve 11 and the photosensitive member 2 is regulated within a range of 3.5~5 kV/mm.

When developing as described above, sufficient toner T is supplied from developing sleeve 11 to the latent image region on photosensitive member 2 to produce images having sufficient image density. The layer of developer 1 on developing sleeve 11 is nearly completely ionized, such that the residual charge remaining on the carrier after toner T is supplied rapidly moves to developing sleeve 11, thereby reducing the countercharging of the carrier and preventing carrier adhesion to the photosensitive member 2. Thus, excellent images are stably produced without carrier-induced nonprinting areas in the formed images, or damage to the photosensitive member 2 by carrier adhesion.

When developing as described above, there is no airborne dispersion of toner T during developing. Thus, there is no fogging of the formed images, nor is there soiling of the interior of the device due to airborne toner dispersion.

In developing device 10, the influence of changing the amount of developer 1 transported by developing sleeve 11 to the developing region opposite photosensitive member 2 was investigated by regulating the amount of developer 1 on developing sleeve 11 is regulated by magnetic blade 13*a*. The influence of changing the oscillating field (Vp-p/Ds) acting between developing sleeve 11 and photosensitive member 2 was investigated by regulating the gap Ds formed between developing sleeve 11 and photosensitive member 2 in the developing region and regulating the peak-to-peak value Vp-p of the AC voltage supplied from developing bias power source 12.

The aforesaid influences were investigated using a developer 1 containing a carrier comprising 100 pbw (parts-by-weight) styrene-acrylic resin, to which was added 200 pbw magnetic powder, carbon black, and silicon oxide to obtain a binder type carrier having a mean particle size of about 20 μm, true specific gravity of 2.4, magnetic force of 1050 G, and resistance value of $1\times10^{14}$ Ω·cm. Carrier particle size was measured using a coulter counter (Coulter, Inc.), magnetic force was measured using a DC magnetization autorecording device (model 3257; Hosokawa Denki, K.K.) under a magnetic field of 1 Öe. The resistance value of the aforesaid carrier was determined by accommodating carrier C in concavity 20*a* of blade 20 to a thickness of 1 mm, disposing 20 mm diameter electrode 21 on the top surface of said carrier C, applying a voltage of 500 V from power source 22 and measuring the current that flowed through the layer of carrier C via ammeter 23, as shown in FIG. 2.

The toner used in developer 1 comprised carbon black, and wax, added to styrene-acrylic resin, the mixture was kneaded and pulverized, and thereafter positive charge-regulating agent (nigrosine; Oriental Chemical Co., Ltd.) was added. The material was subjected to silicon oxide processing, and suitable classification processing to obtain a positive charging toner having a mean particle size of 11 μm. The toner and the previously mentioned carrier were mixed to produce developer 1 having a suitable toner density.

Developer 1 having a toner concentration of 20 percent-by-weight was used in developing device 10. The amount of developer transported by developing sleeve 11 to the developing region was regulated by magnetic blade 13*a* to set transported amounts of 2.5 mg/cm$^2$, and 30 mg/cm$^2$.

Developing was accomplished using the developing device 10 under the following conditions. The circumferential speed V2 of photosensitive member 2 was set at 120 mm/s, and the ratio θ (V1/V2) of the circumferential speed V1 of developing sleeve 11 and the circumferential speed V2 of photosensitive member 2 was set at 2. The surface potential of the toner-receiving region of photosensitive member 2 was set at −440 V, and the surface potential of the photosensitive member 2 not receiving toner was set at −210 V.

A developing bias voltage comprising −250 V DC with an overlaid AC current having a peak-to-peak value Vp-p of 0~3 kV and duty ratio (developing:recovery) of 1:1 with a square wave frequency of 2 kHz was supplied from developing bias power source 12. The space Ds between developing sleeve 11 and photosensitive member 1 in the developing region was set at 0.3~0.6 mm, and the intensity of the oscillating electric field (Vp-p/Ds) which acted in the developing region was varied.

Figure 7:
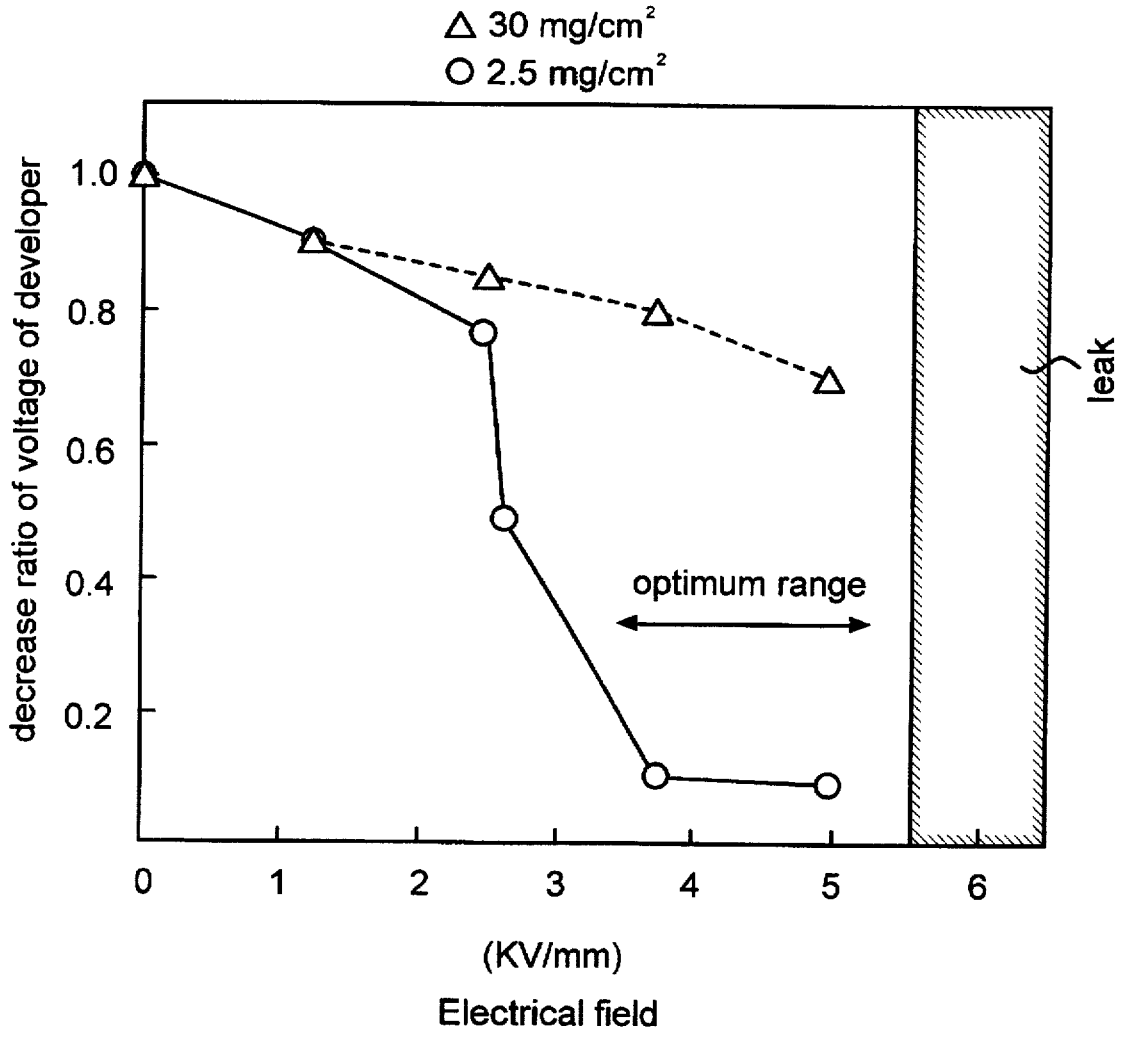
FIG. 7 is a graph showing the potential attenuation of the developer layer when developing is accomplished by varying the intensity of the oscillating field acting in the developing region with the amount of developer transported by the developing sleeve set at 30 mg/cm$^2$ and 2.5 mg/cm$^2$.

The amount of developer 1 transported to the developing region by developing sleeve 11 was regulated to 2.5 mg/cm$^2$ and 30 mg/cm$^2$, and in each case the intensity of the oscillating electric field (Vp-p/Ds) acting in the developing region was varied to examine the relationship between the intensity of said oscillating electric field and the potential attenuation of the layer of developer on developing sleeve 11. The results are shown in FIG. 7. In FIG. 7, the results when the amount of transported developer 1 was 2.5 mg/cm$^2$ are indicated by the symbol · and a solid line, and the results when the amount of transported developer 1 was 30 mg/cm$^2$ are indicated by the symbol Δ and a dashed line. The potential attenuation of the developer layer was determined by supplying toner from the developer on developing sleeve 11 to photosensitive member 2, and stopping the development midway, and measuring the electric potential of the developer layer on said developing sleeve 11. The electric potential of the developer layer when the AC voltage was not applied was designated 1, and potential attenuation was expressed as the ratio of the two values.

When the oscillating electric field (Vp-p/Ds) acting in the developing region was excessively weakened, there was only slight attenuation of the potential in the layer of developer regardless of the amount of developer 1 on developing sleeve 11, such that movement of the charge of the carrier deteriorates after toner is supplied and developing is achieved, resulting in a residual countercharge remaining on the majority of the carrier which causes a majority of the carrier to adhere to the photosensitive member 2. However, when the oscillating electric field is too strong at over 5.5 kV/mm, leaks occur between the developing sleeve 11 and photosensitive member 2.

On the other hand, when the intensity of the oscillating filed (Vp-p/Ds) is regulated within a range of 3.5~5 kV/mm and the amount of developer 1 transported by developing sleeve 11 is set at 2.5 mg/cm$^2$ which is within the range of 0.7~5.0 mg/cm$^2$, the attenuation of potential of the developer layer increases and the developer layer is completely ionized, such that there is rapid movement of the charge remaining on the carrier after toner is supplied, thereby preventing adhesion of the carrier on photosensitive member 2. In contrast, when the amount of transported developer 1 is set at 30 mg/cm$^2$, there is only slight potential attenuation of the developer layer regardless of the action of the oscillating field within a range of 3.5~5 k V/mm, such that there is poor movement of the charge remaining on the carrier after toner is supplied which causes a countercharge to remain on the majority of the carrier that leads to adhesion of a large amount of carrier on photosensitive member 2.

Then, the toner concentration in the developer was regulated within a range of 5~30 percent-by-weight, and the amount of developer transported by developing sleeve 11 in developing device 10 was varied within a range of 2~30 mg/cm$^2$, as shown in Table 7 below.

When developing using developing device 10, the circumferential speed V2 of photosensitive member 2 was set at 120 mm/s, and the ratio θ (V1/V2) of the circumferential speed V1 of developing sleeve 11 and the circumferential speed V2 of photosensitive member 2 was regulated within a range of 1~3. The surface potential of the photosensitive member receiving toner was set at −440 V, and the surface potential of the photosensitive member 2 not receiving toner was set at −210 V. A developing bias voltage comprising −400~+640 V DC with an overlaid AC current having a duty ratio (developing:recovery) of 1:1~1:3 with a square wave frequency of 2~4 kHz was supplied from developing bias power source 12.

The peak-to-peak value Vp-p of the AC voltage was regulated within a range of 0.75~3 kV, and the space Ds between developing sleeve 11 and photosensitive member 2 in the developing region was set within a range of 0.3~0.6 mm. The oscillating field (Vp-p/Ds) acting in the developing region was varied within a range of 2.5~5 kV/mm, as shown in Table 7.

The amount of developer 1 transported by developing sleeve 11 and the oscillating field (Vp-p/Ds) acting in the developing region were varied as indicated in Table 7, and the state of the carrier adhering to photosensitive member 2 was investigated under the aforesaid conditions, and the results are shown in Table 7. In Table 7, the state of carrier adhesion on photosensitive member 2 was evaluated visually in five levels. Complete lack of carrier adhesion was rated 5, slight carrier adhesion was rated 4, some carrier adhesion was rated 3, definite carrier adhesion was rated 2, and complete carrier adhesion was rated 1. When the oscillating field acting in the developing region was excessively strong so as to cause leaking to photosensitive member 2, the situation is indicated by "leak" in the table.

TABLE 7

| Amount of transported developer | Oscillating field (KV/mm) | | | | | | |
|---|---|---|---|---|---|---|---|
| (mg/cm$^2$) | 2.5 | 3.0 | 3.5 | 4.0 | 4.5 | 5.0 | 5.5 |
| 2 | 3 | 3~4 | 5 | 5 | 5 | 5 | Leak |
| 5 | 3 | 3~4 | 5 | 5 | 5 | 5 | Leak |
| 10 | 2 | 2~3 | 3~4 | 3~4 | 3~4 | 3~4 | Leak |
| 15 | 1~2 | 1~2 | 2~3 | 2~3 | 2~3 | 2~3 | Leak |
| 20 | 1 | 1 | 1~2 | 1~2 | 1~2 | 1~2 | Leak |
| 25 | 1 | 1 | 1 | 1 | 1 | 1 | Leak |
| 30 | 1 | 1 | 1 | 1 | 1 | 1 | Leak |

As the above results clearly show, when developing is accomplished with the amount of transported developer on developing sleeve 11 set at 5 mg/cm$^2$ and the oscillating field set within a range of 3.5~5.5 kV/mm, carrier adhesion on photosensitive member 2 is completely absent. In contrast, when the amount of developer 1 transported on developing sleeve 11 is greater than 5 mg/cm$^2$ and the oscillating field becomes weaker, the carrier adhesion on photosensitive member 2 increases accordingly. Furthermore, leaks occur between developing sleeve 11 and photosensitive member 2 whenever the oscillating field is set 5.5 kV/mm and the field intensity becomes to great.

Toner concentration in developer 1 and the ratio θ (V1/V2) of the circumferential speeds of developing sleeve 11 and photosensitive member 2 in developing device 10 were varied and developing was performed using developing device 10. The state of the formed images and state of toner dispersion during developing were studied.

When developing using developing device 10, the surface potential of the photosensitive member 2 receiving toner was set at −440 V, and the surface potential of the photosensitive member 2 not receiving toner was set at −210 V. A developing bias voltage comprising −400~+640 V DC with an overlaid AC current having a duty ratio (developing:recovery) of 1:1~1:3 with a square wave frequency of 2~4 kHz was supplied from developing bias power source 12. The AC voltage peak-to-peak value Vp-p and gap Ds between developing sleeve 11 and photosensitive member 2 were regulated to achieve an oscillating field (Vp-p/Ds) acting in the developing region of 4 kV/mm.

As shown in Table 8, developing was accomplished by changing the toner concentration in developer 1 within a range of 5~30 percent-by-weight, and changing ratio θ (V1/V2) of the circumferential speeds of developing sleeve 11 and photosensitive member 2 in developing device 10 within a range of 0.5~3.5. The state of the images formed under these conditions and image density were examined, as was the state of toner dispersion. Results are shown in Table 8. Evaluation rating shown in Table 8, "insuff." denotes density insufficiency when the density of the formed image was less than 1.3, "blur" denotes trailing edge blurring, and "dispersion" denotes toner dispersion; the symbol ○ denotes the production of images having sufficient image density without trailing edge blurring or toner dispersion.

TABLE 8

| Toner concentration | θ | | | | | | |
|---|---|---|---|---|---|---|---|
| (wt %) | 0.5 | 1.0 | 1.5 | 2.0 | 2.5 | 3.0 | 3.5 |
| 5 | insuff | insuff | insuff | insuff | insuff | insuff | insuff dispersion blur |
| 10 | insuff | ○ | ○ | ○ | ○ | ○ | dispersion blur |
| 15 | insuff | ○ | ○ | ○ | ○ | ○ | dispersion blur |
| 20 | insuff | ○ | ○ | ○ | ○ | ○ | dispersion blur |
| 25 | insuff | ○ | ○ | ○ | ○ | ○ | dispersion blur |
| 30 | dispersion insuff | dispersion | dispersion | dispersion | dispersion | dispersion | dispersion blur |

As is clearly shown from the aforesaid results, when toner concentration in developer 1 is less than 5 percent-by-weight, and when the ratio θ of the circumferential speeds of developing sleeve 11 and photosensitive member 2 is less than 0.5, insufficient toner in the developer was delivered from developing sleeve 11 to photosensitive member 2, and image density was insufficient in the obtained images. When toner concentration in developer 1 was greater than 30 percent-by-weight, toner dispersion occurred during developing. When the ratio θ of the circumferential speeds of developing sleeve 11 and photosensitive member 2 was greater than 3.5, toner dispersion occurred as did blurring of the trailing edge of the formed toner image by the scraping of the magnetic brush on developing sleeve 11 coming from behind said toner image due to the excessive circumferential speed of developing sleeve 11.

Thus, from the perspective of having sufficient toner concentration without trailing edge blurring, the toner concentration in developer 1 is desirably regulated to 10~25 percent-by-weight, and the ratio θ (V1/V2) of the circumferential speeds of developing sleeve 11 and photosensitive member 2 is desirably regulated within a range of 1~3.

Then, the relationship between AC field intensity and the amount of transported developer was investigated relative to line reproducibility. The developing device used regulated AC field intensity by changing the output of the developing bias power source, and the amount of transported developer was controlled by regulating the gap between the developing sleeve and magnetic blade 13*a*.

The toner used was produced by adding 10 pbw carbon black, 5 pbw polypropylene was (Mn=5,000), 5 pbw azo type metal complex as a charge-controlling agent, and 50 pbw Zn-ferrite (particle size 0.6 μm) to 100 pbw styrene-acrylic resin (Mm= 15,000; Mw=200,000), the mixture was kneaded and pulverized, then 0.1 pbw colloidal silica was added to produce a toner having a volumetric mean particle size of 8 μm.

The carrier used was a binder type carrier produced by kneading and pulverizing 100 pbw styrene-acrylic resin, 200 pbw magnetite magnetic powder, and 6 pbw carbon black.

The developer used comprised a weight ratio of 20 percent-by-weight toner and 80 percent-by-weight carrier.

Line reproducibility was investigated using the previously described developing device and developer, and changing the amount of transported developer and AC field intensity. Line reproducibility was evaluated by visually inspecting test chart reproducibility using character and line images.

Line reproducibility was evaluated by the following rankings. Images having sufficient density and uniform thickness without any trace of blurring of characters or lines are indicated by the symbol ⊙, images having somewhat less reproducibility are indicated by the symbol ○, images having reproducibility of the lowest practical limit are indicated by the symbol Δ, images having reproducibility unusable in practice are indicated by the symbol X, and images partially or wholly unreproducible are indicated by the symbol XX.

Figure 8:
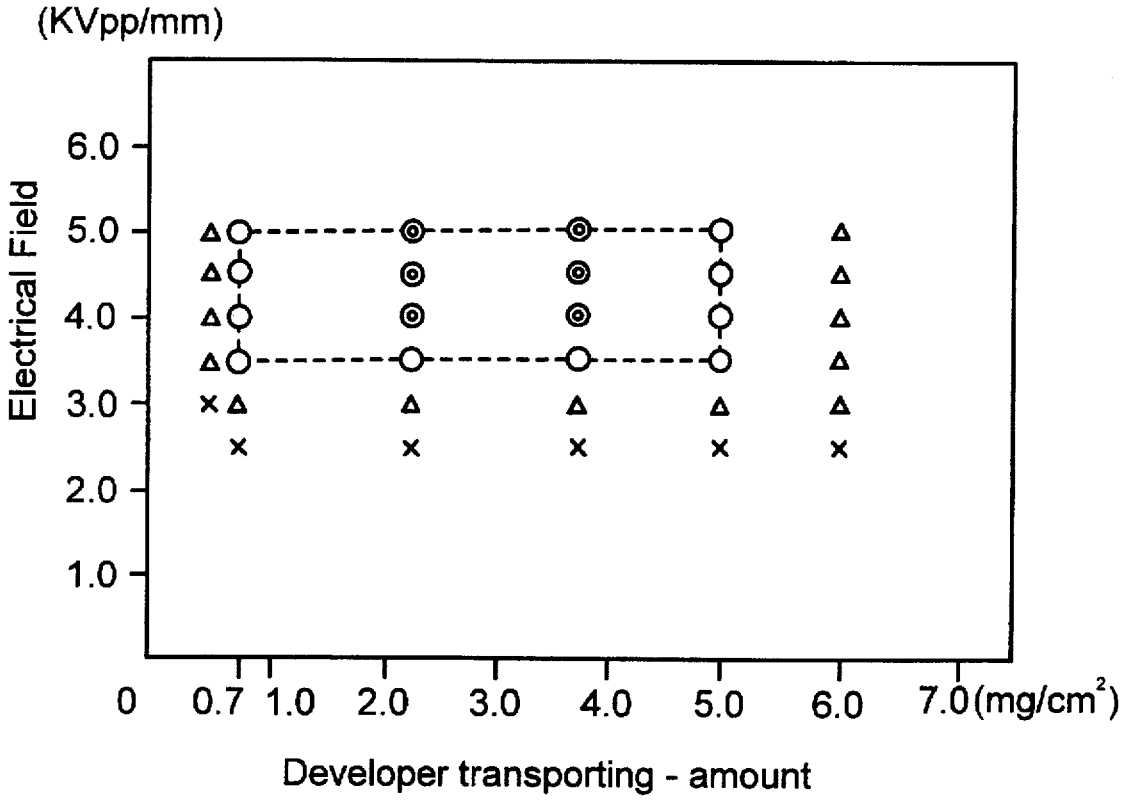
FIG. 8 is a graph showing the influence of the electric field and amount of transported developer in line reproducibility.

The evaluation results are shown in FIG. 8.

Then, the type of carrier used in developer 1 was varied to study the influence on carrier magnetic force on developing.

Carrier was produced combining magnetic powder within a range of 200~700 pbw to 100 pbw polyester resin or styrene-acrylic resin to produce carriers 1~8 having the true specific gravity, particle diameter, and mean magnetic force per unit of carrier ($G \cdot cm^3$) described in Table 9. Mean magnetic force per unit of carrier ($G \cdot cm^3$) was determined by measuring magnetic force (G) of each carrier using the previously described DC magnetization autorecording device (model 3257; Hosokawa Denki, K.K.) under a magnetic field of 1 Öe, and multiplying the result by the volume of a unit of each carrier.

On the other hand, toner was produced by adding carbon black, wax, and negative charge-controlling agent (chrome-containing metal stain) to polyester resin, and subjecting the mix to post processing with silicon oxide to obtain a negative charge type toner having a particle size of about 8 μm. The toner and the aforesaid carriers 1~8 were mixed to produce developers having a toner concentration of 18 percent-by-weight.

In developing device 10, the circumferential speed of photosensitive member 2 was set at 180 mm/s, the ratio θ (V1/V2) of the speeds of developing sleeve 11 and photosensitive member 2 was set at 1.8, the amount of developer 1 transported by developing sleeve 11 was set at 4.0 $mg/cm^2$, and the gap Ds between developing sleeve 11 and photosensitive member 2 was set at 0.3 mm. The surface potential of the photosensitive member 2 receiving toner was set at −80 V, and the surface potential of photosensitive member 2 not receiving toner was set at −280 V. A developing bias voltage comprising −220 V DC with an overlaid AC current having a duty ratio (developing:recovery) of 1:1 with a square wave frequency of 3 kHz was supplied from developing bias power source 12. The AC voltage peak-to-peak value Vp-p was set at 1.25 kV (4.16 kV/mm). Reversal developing was accomplished via the action of the oscillating field in the developing region.

When reversal developing was accomplished using developers containing carriers 1~8 shown in Table 9, the state of magnetic flocculation of each developer on developing sleeve 11 was examined; the results are shown in Table 9. In Table 9, the state of magnetic flocculation in the developers was evaluated visually at five levels. Complete lack of magnetic flocculation with uniform developer layer on developing sleeve 11 was rated 5, slight magnetic flocculation was rated 4, some magnetic flocculation was rated 3, definite magnetic flocculation was rated 2, and complete magnetic flocculation was rated 1.

TABLE 9

| Carrier | True specific gravity | Particle size (μm) | Mean magnetic force per unit (G/cm*) | Magnetic flocculation |
|---|---|---|---|---|
| 1 | 2.4 | 20 | $4.4 \times 10^{-5}$ | 5 |
| 2 | 2.4 | 25 | $8.6 \times 10^{-5}$ | 5~4 |
| 3 | 3.38 | 35 | $2.4 \times 10^{-5}$ | 3 |
| 4 | 3.38 | 15 | $4.1 \times 10^{-5}$ | 5 |
| 5 | 3.38 | 26 | $2.1 \times 10^{-5}$ | 2 |
| 6 | 3.38 | 60 | $2.6 \times 10^{-4}$ | 1 |
| 7 | 3.38 | 70 | $4.1 \times 10^{-4}$ | 2 |
| 8 | 3.47 | 36 | $7.5 \times 10^{-5}$ | 1 |

The aforesaid results clearly indicate that in the case of developers using the aforesaid carriers 3 and 5~8 having a mean magnetic force per unit of carrier greater than $9 \times 10^{-8}$ $G \cdot cm^3$, there was partial magnetic flocculation by carrier C in developer 1 on developing sleeve 11, as shown in FIG. 3, which caused irregularity in the amount of developer 1 on developing sleeve 11, which in turn caused density irregularities in the formed image and poor image texture. Conversely, in the case of developers using carriers 1, 2, and 4 having a mean magnetic force per unit of carrier less than $9 \times 10^{-8}$ $G \cdot cm^3$, there was no flocculation of carrier C, and developer 1 was uniformly distributed on developing sleeve, as shown in FIG. 5, and uniformly fine texture images were obtained without density irregularities.

In the previously described preferred embodiment of the present invention, a developer comprising a toner and a carrier is transported to a developing region opposite an image-bearing member by a developer transporting member, and developing is accomplished by supplying toner from the developer on the developer transporting member to the image-bearing member in the developing region via the action of an oscillating field in the developing region. The amount of transported developer delivered to the developing region on the developer transporting member and the oscillating field acting in the developing region are suitably regulated as previously described so as to deliver sufficient toner to the image-bearing member during developing and produce line images having sufficient image density.

After toner is supplied, the residual charge on the carrier rapidly moves the developer transporting member, such that countercharging of the carrier is minimized, and carrier adhesion on the image-bearing member is suppressed. Thus, carrier-induced nonprinting in the formed images does not occur, and excellent noise-free images are reliably obtained.

Furthermore, toner dispersion during developing by toner in the developer supplied to the image-bearing member in the developing region is minimized, allowing excellent images without fogging to be obtained. In addition, there is no soiling by the dispersed toner within the apparatus such as a copier or the like.

Figure 12:
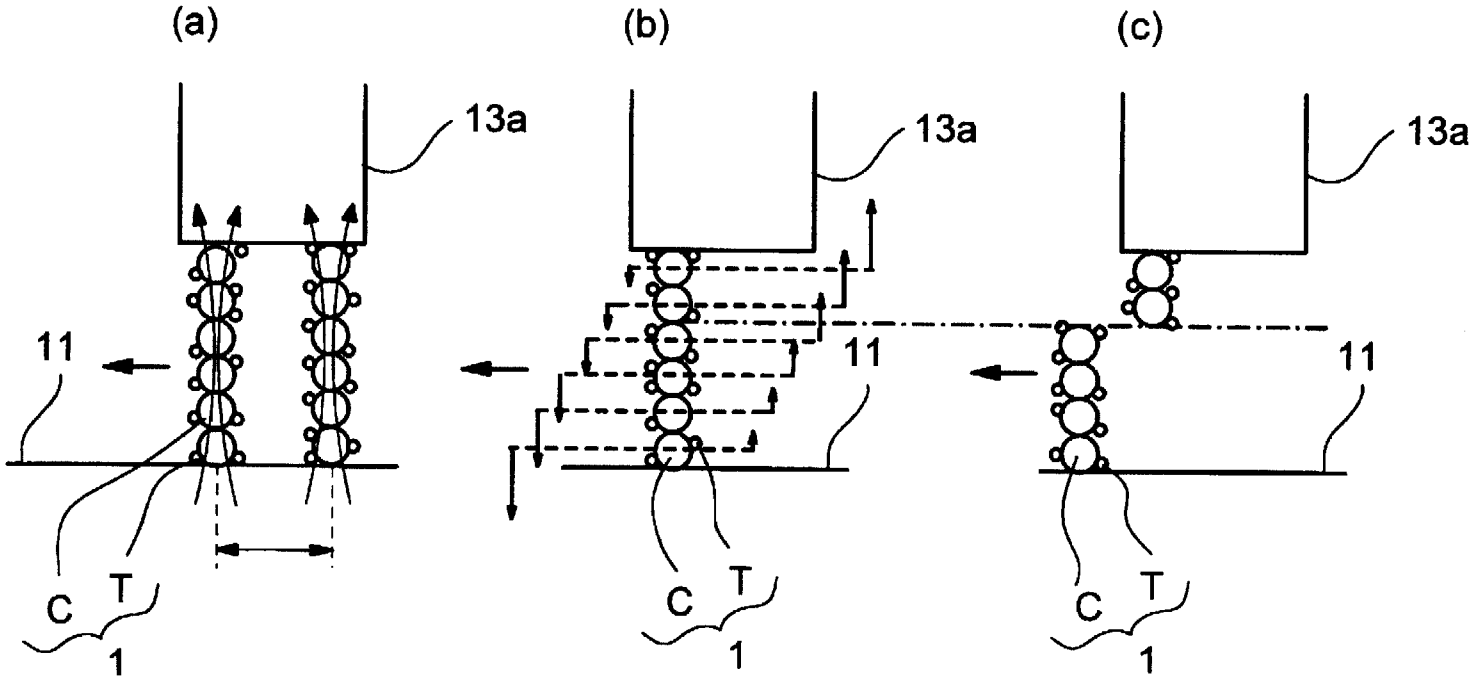
FIG. 12 is a partial enlargement showing the amount of developer on the developing sleeve regulated by a magnetic blade in an embodiment of the developing method of the present invention.

As shown in FIGS. 12*a–c*, when the amount of developer 1 on developer transporting member 11 is regulated by the aforesaid magnetic blade 13*a*, a magnetic force is exerted one the magnetic brush of developer 1 from magnetic blade 13*a* and magnet roller 11*a* provided inside developing sleeve 11 when the magnetic brush of developer 1 comprising a toner T and a carrier C passes the position of magnetic blade 13*a*. The magnetic brush of developer 1 is sectioned at a suitable position by the aforesaid exerted magnetic force, such that a suitable amount of developer 1 passes magnetic blade 13*a* and is transported to the developing region opposite photosensitive member 2.

One embodiment of the developing method of the present invention is realized using the aforesaid developing device 10, and developer 1 having a bulk-compensated specific gravity of 0.28~0.37, and angle of repose within a range of 38°~52°. The amount of developer 1 transported via the rotating developing sleeve 11 to the developing region opposite photosensitive member 2 is regulated by the aforesaid magnetic blade 13*a*, such that the amount of developer 1 transported by developing sleeve 11 is regulated within a range of 0.7~5.0 mg/cm$^2$. Thereafter, the regulated developer 1 is delivered to the developing region opposite photosensitive member 2 via developing sleeve 11, a developing bias voltage is applied from developing bias power source 12 to form an oscillating electric field in the developing region by which toner T contained in developer 1 transported by developing sleeve 11 is supplied to an electrostatic latent image formed on photosensitive member 2 to develop said latent image.

When developer 1 is used as described above, the amount of developer 1 transported on developing sleeve 11 is regulated by magnetic blade 13*a* and the amount of developer 1 transported to the developing region is regulated within a range of 0.7~5.0 mg/cm$^2$, there is no flocculation of developer 1 on developing sleeve 11, and there is scant change in the sectioning position when the magnetic brush of developer 1 is sectioned by magnetic blade 13*a*, such that developer 1 on developing sleeve 11 is delivered to the developing region in a uniform thin layer state. When developing is accomplished with in the aforesaid state, high resolution images are obtained which have sufficient image density and uniformly fine texture without density irregularities. Furthermore, carrier does not adhere to photosensitive member 2, thereby preventing carrier-induced nonprinting spots in the formed image as well and avoiding noise in the formed image due to carrier-induced damage to the photosensitive member 2. Airborne dispersion of toner T during development is also greatly reduced, thereby preventing fogging of the formed images and soiling of the interior of the device by the dispersed toner T.

Experiments were conducted on the developer in which the types and mixture ratios of carriers and toner were varied, and the bulk-compensated specific gravity and angle of repose of the developers were modified, and the resultant developers were used in developing device 10. It will be understood from the following discussion that developers satisfying the conditions described by the present invention performed excellently.

In the experiments, the toners used in the developer were toner T1 of a positive charging type which had a mean particle size of about 11 μm, and toner T2 of a negative charging type having a mean particle size of about 8 μm.

The carriers used in the developer are described in Table 10 below. Ten types of carriers C1~C10 were used, including binder type carriers C1~C7, C9 and C10 having different particle sizes and amounts of magnetic powder, and ferrite carrier C8. The amount of magnetic powder contained in binder type carriers C1~C7, C9 and C10 are amounts relative to 100 parts-by-weight of resin.

The constituents of toners T1 and T2, and carriers C1~C10 are shown in Tables 10B and 10C.

TABLE 10

| Carrier | Particle dia. (μm) | Magnetic powder (parts-by-weight) | Type |
|---|---|---|---|
| C1 | 20 | 200 | Binder |
| C2 | 35 | 200 | Binder |
| C3 | 15 | 500 | Binder |
| C4 | 26 | 500 | Binder |
| C5 | 60 | 500 | Binder |
| C6 | 70 | 500 | Binder |
| C7 | 36 | 650 | Binder |
| C8 | 35 | — | Ferrite |
| C9 | 35 | 100 | Binder |
| C10 | 15 | 600 | Binder |

TABLE 10B

| | Toner Constituents | | | | | |
|---|---|---|---|---|---|---|
| | Resin | CCA | WAX | CB | Magnetic powder | Post process |
| T1 | polyester | 5.5 | 5 | 10 | 2 | silica 0.2% |
| T2 | 100 | 5 | 3 | 8 | 0.2 | silica 0.4% titanium 0.2% |

Polyester Mn = 15,000; Mw = 200,000; Tg = 63° C.
CCA Azo containing metallic dye
WAX Polypropylene wax (550P Biscol)
CB (carbon black)
Silica 60 μm colloidal silica
Titanium EC300 (Titanium Kogyousha)

TABLE 10C

| | Carrier Constituents | | | |
|---|---|---|---|---|
| | Resin (parts) | Magnetic powder (parts) | CB (parts) | silica |
| C1 | polyester 100 | magnetite 200 | 2 | 2% |
| C2 | polyester 100 | ferrite 500 | 2 | 2% |
| C3 | polyester 100 | ferrite 500 | 2 | 1.5% |

TABLE 10C-continued

| | Carrier Constituents | | | |
|---|---|---|---|---|
| | Resin (parts) | Magnetic powder (parts) | CB (parts) | silica |
| C4 | polyester 100 | ferrite 500 | 2 | 1.5% |
| C5 | polyester 100 | ferrite 500 | 2 | 1.5% |
| C6 | polyester 100 | ferrite 500 | 2 | 1.5% |
| C7 | polyester 100 | ferrite 650 | 2 | 1.5% |
| C8 | — | Mn—Zn ferrite 100 | — | — |
| C9 | polyester 100 | magnetite 100 | 2 | 2% |
| C10 | polyester 100 | ferrite 600 | 2 | 1.5% |

Magnetite Hc = 200 Öe; ϭm = 55 emu/g (1K/Öe magnetic field)
Ferrite Hc = 1200 Öe; ϭm = 65 emu/g (1K/Öe magnetic field)
Mn—Zn ferrite Hc = 10 Öe; ϭm = 55 emu/g (1K/Öe magnetic field)

Toner T1 and carriers C1~C10 were combined so as to obtain developers 1~17 and developers (a)~(g) having the same toner densities Tc (wt %). The true specific gravities and bulk specific gravities of developers 1~17 and developers (a)~(g) were measured to determined the bulk-compensated specific gravities of said developers. The angle of repose of each of the aforesaid developers was also measured. The results are shown in Table 11.

TABLE 11

| Dev. | Toner | Carrier | Tc (wt %) | True specific gravity | Bulk-compen-sated specific gravity | Angle of repose (°) | Transport amount mg/cm² |
|---|---|---|---|---|---|---|---|
| 1 | T1 | C1 | 10 | 2.15 | 0.381 | 42.5 | 2.12 |
| 2 | T1 | C1 | 20 | 1.94 | 0.380 | 39.5 | 1.98 |
| 3 | T1 | C2 | 10 | 2.04 | 0.412 | 38.0 | 2.98 |
| 4 | T1 | C2 | 20 | 1.87 | 0.400 | 40.0 | 2.74 |
| 5 | T1 | C3 | 10 | 2.80 | 0.295 | 48.0 | 2.04 |
| 6 | T1 | C3 | 20 | 2.39 | 0.310 | 50.0 | 1.80 |
| 7 | T1 | C4 | 10 | 2.80 | 0.378 | 40.5 | 3.12 |
| 8 | T1 | C4 | 20 | 2.39 | 0.375 | 42.5 | 2.78 |
| 9 | T1 | C4 | 30 | 2.08 | 0.378 | 50.0 | 1.80 |
| 10 | T1 | C5 | 5.7 | 3.02 | 0.446 | 32.5 | 4.24 |
| 11 | T1 | C5 | 10 | 2.80 | 0.432 | 34.5 | 3.02 |
| 12 | T1 | C8 | 4.8 | 3.07 | 0.453 | 34.5 | 3.00 |
| 13 | T1 | C6 | 10 | 2.80 | 0.439 | 37.0 | 2.80 |
| 14 | T1 | C7 | 10 | 2.85 | 0.413 | 36.0 | 2.76 |
| 15 | T1 | C8 | 10 | 3.89 | 0.492 | 32.0 | 4.20 |
| 16 | T1 | C9 | 10 | 1.88 | 0.338 | 36.0 | 2.23 |
| 17 | T1 | C10 | 30 | 2.08 | 0.324 | 54.0 | 4.11 |
| a | Same as developer 1 | | | | | | 0.65 |
| b | Same as developer 1 | | | | | | 5.08 |
| c | Same as developer 6 | | | | | | 0.62 |
| d | Same as developer 6 | | | | | | 5.22 |
| e | Same as developer 11 | | | | | | 0.60 |
| f | Same as developer 11 | | | | | | 5.18 |
| g | Same as developer 11 | | | | | | 7.61 |

It is understood from the above results shown in Table that developers 1, 2, 5, and 6 are satisfactory since the bulk-compensated specific gravity is within a range of 0.28~0.37, and angle of repose is 38°~52°, but developers 3, 4, and 7~17 are not satisfactory.

Each developer 1~17 and each developer (a)~(g) was used in developing device 10. The space between developing sleeve 11 and magnetic blade 13*a* was set at 0.2 mm to regulate the amount of developer 1 transported to the developing region by developing sleeve 11. The space Ds between developing sleeve 11 and photosensitive member 2 in the developing region was set at 0.3 mm, the circumferential speed of photosensitive member 2 was set at 120 mm/s, the circumferential speed of developing speed 11 was set at 240 mm/s, and the surface potential of the photosensitive member receiving toner was set at −440 V, and the surface potential of the photosensitive member 2 not receiving toner was set at −210 V. A developing bias voltage comprising +180 V DC with an overlaid AC current having a peak-to-peak value Vp-p of 1.5 kV and duty ratio (developing:recovery) of 1:3 with a square wave frequency of 2 kHz was supplied from developing bias power source 12 to accomplish standard developing. The state of developer 1 transported to the developing region via developing sleeve 11 was checked, and the obtained image evaluated. The amount of transported developer suitable for each developer is shown in Table 11.

Evaluation of the obtained images was conducted by checking density irregularity and texture of the obtained images for an overall evaluation. Density irregularity was evaluated as five levels by visual inspection; a complete absence of density irregularity was rated 5, slight density irregularity which posed no problem was rated 4, definite density irregularity was rated 3, pronounced density irregularity was rated 2, and severe density irregularity was rated 1. Texture was also rated as five levels by visual inspection. Exceptionally detailed texture without trace of dispersion in halftone images was rated 5, fine texture with slight dispersion was rated 4, reduced texture with definite dispersion was rated 3, poor texture with pronounced dispersion was rated 2, and exceptionally poor texture was rated 1. Overall evaluation was rated as five levels A~E. Excellent was rated A, good was rated B, slightly reduced image quality was rated C, definitely reduced image quality was rated D, and poor image quality was rated E. The Evaluation results are shown in Table 12.

TABLE 12

| Developer | Density irregularity | Texture | Overall evaluation |
|---|---|---|---|
| 1 | 5 | 4 | B |
| 2 | 5 | 4 | B |
| 3 | 3 | 2 | D |
| 4 | 3 | 3 | C |
| 5 | 5 | 5 | A |
| 6 | 5 | 5 | A |
| 7 | 3 | 3 | C |
| 8 | 3 | 3 | C |
| 9 | 3 | 3 | C |
| 10 | 1 | 1 | E |
| 11 | 1 | 1 | E |
| 12 | 1 | 1 | E |
| 13 | 1 | 1 | E |
| 14 | 1 | 1 | E |
| 15 | 3 | 1 | D |
| 16 | 2 | 4 | C |
| 17 | 3 | 3 | C |

Developers 1, 2, 5, and 6 were satisfactory, and exhibited scant density irregularity in the obtained images, and all were rated at B or higher for fine texture in the overall evaluation. In contrast, developers 3, 4, and 7~17, which were not satisfactory, exhibited density irregularity in the obtained images, and were rated at C or lower for poor texture.

Developers (a)~(g) are examples wherein the amount of transported developer was outside the range of 0.7~5.0 mg/cm², as shown in Table 11.

In these examples, image density and carrier adhesion were evaluated.

Image density was evaluated by producing solid images using the developing device shown in FIG. 6 and measuring the image density using a MacBeth RDP20 (MacBeth, Inc.). Carrier adhesion was evaluated using the same solid images, and rating carrier adhesion at five levels. Excellent results with no carrier adhesion was rated 5, good results with carrier adhesion which posed no problem was rated 4, some carrier adhesion which presented some problem was rated 3, poor results with definite carrier adhesion was rated 2, and extremely severe carrier adhesion was rated 1. The results are shown in Table 13.

TABLE 13

| Developer | Density | Carrier adhesion |
|---|---|---|
| (a) | 1.25 | 5 |
| (b) | 1.44 | 2 |
| (c) | 1.21 | 5 |
| (d) | 1.48 | 2 |
| (e) | 1.20 | 5 |
| (f) | 1.46 | 2 |
| (g) | 1.57 | 1 |

Negative charging toner T2 and carriers C1~C7 were combined as shown in Table 14, to obtained developers 18~30 and developers (h)~(m) regulated so as to have the toner densities Tc (wt %) shown in the table. The true specific gravity and bulk specific gravity of the aforesaid developers were measured to determine the bulk-compensated specific gravity of each developer. The angle of repose was also measured. The results are shown in Table 14.

TABLE 14

| Dev. | Toner | Carrier | Tc (wt %) | True specific gravity | Bulk-compen-sated specific gravity | Angle of repose (°) | Transport amount mg/cm² |
|---|---|---|---|---|---|---|---|
| 18 | T2 | C1 | 6 | 2.22 | 0.364 | 40.5 | 2.32 |
| 19 | T2 | C1 | 15 | 2.00 | 0.361 | 39.5 | 2.44 |
| 20 | T2 | C2 | 8 | 2.11 | 0.421 | 35.0 | 3.36 |
| 21 | T2 | C2 | 15 | 2.00 | 0.409 | 35.0 | 3.26 |
| 22 | T2 | C3 | 8 | 2.95 | 0.300 | 41.0 | 2.64 |
| 23 | T2 | C3 | 15 | 2.66 | 0.308 | 43.0 | 2.18 |
| 24 | T2 | C4 | 8 | 2.95 | 0.386 | 37.5 | 4.16 |
| 25 | T2 | C4 | 15 | 2.66 | 0.377 | 40.0 | 3.52 |
| 26 | T2 | C5 | 4.8 | 3.12 | 0.459 | 32.0 | 3.28 |
| 27 | T2 | C5 | 8 | 2.95 | 0.459 | 34.0 | 3.46 |
| 28 | T2 | C6 | 3.9 | 3.16 | 0.474 | 31.5 | 4.26 |
| 29 | T2 | C6 | 8 | 2.95 | 0.481 | 32.5 | 3.74 |
| 30 | T2 | C7 | 8 | 3.01 | 0.415 | 37.0 | 3.66 |
| h | Same as developer 18 | | | | | | 0.66 |
| i | Same as developer 18 | | | | | | 5.11 |
| j | Same as developer 23 | | | | | | 0.58 |
| k | Same as developer 23 | | | | | | 5.55 |
| l | Same as developer 27 | | | | | | 0.60 |
| m | Same as developer 27 | | | | | | 5.22 |

Developers 18, 19, 22, and 23 were satisfactory wherein bulk-compensated specific gravity is within a range of 0.28~0.37, and angle of repose is within a range of 38°~52°. Developers 20, 21, and 24–30 were not satisfactory.

Each developer 18~30 and each developer (h)~(m) was used in developing device 10. The space between developing sleeve 11 and magnetic blade 13*a* was set at 0.2 mm to regulate the amount of developer 1 transported to the developing region by developing sleeve 11 at 2.32~4.26 mg/cm². The space Ds between developing sleeve 11 and photosensitive member 2 in the developing region was set at 0.3 mm, the circumferential speed of photosensitive member 2 was set at 180 mm/s, the circumferential speed of developing speed 11 was set at 32 4 mm/s, and the surface potential of the photosensitive member receiving toner was set at −80 V, and the surface potential of the photosensitive member 2 not receiving toner was set at −280 V. The state of developer 1 transported to the developing region via developing sleeve 11 was checked, and the obtained images evaluated.

Figure 13:
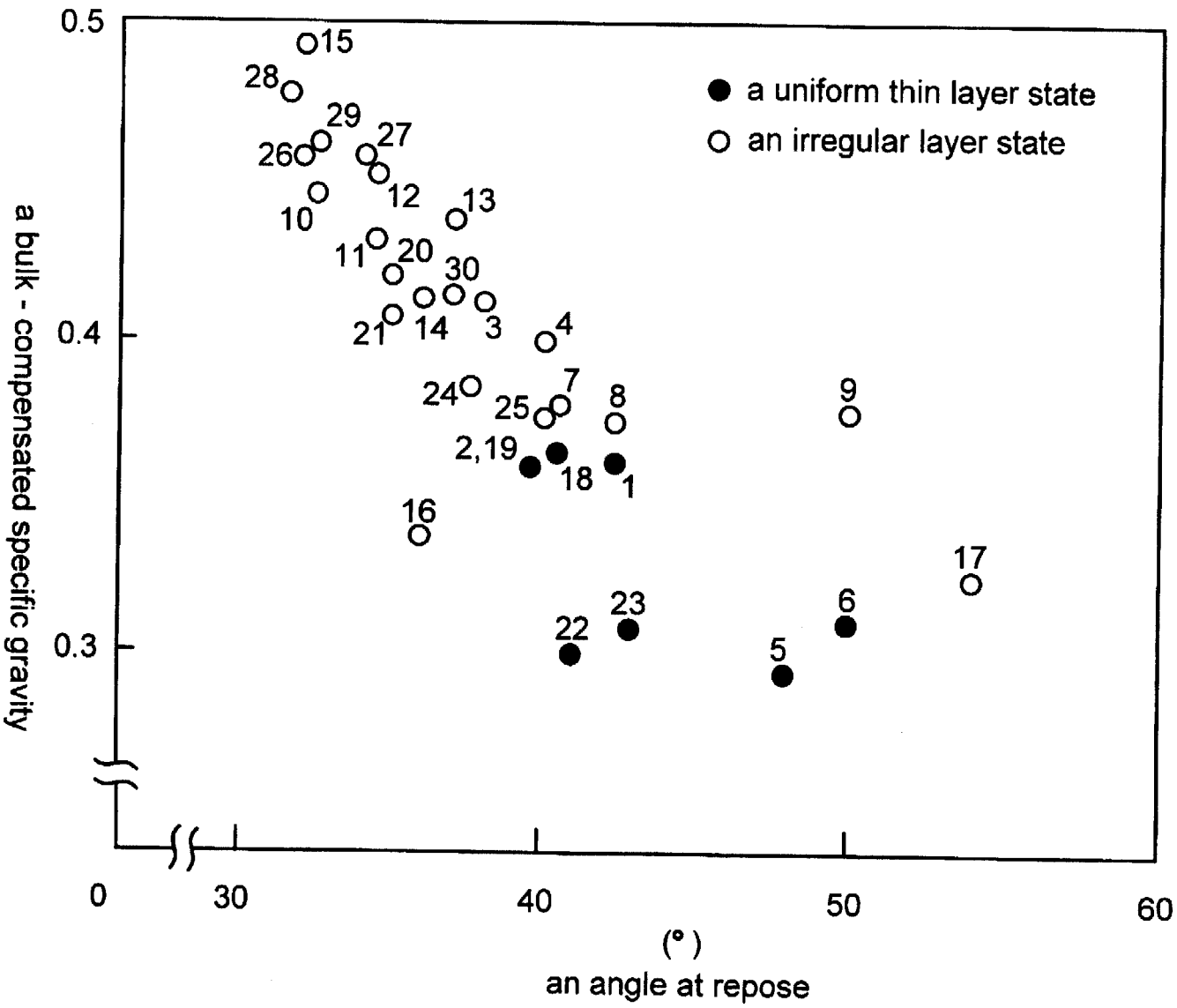
FIG. 13 is a graph showing the state of the developer on a developing sleeve when developers 1~30 having different bulk-compensated specific gravities and angles of repose are used and the amount of developer on the developing sleeve is regulated by a magnetic blade.

With developer 1 in the state of being transported to the developing region by developing sleeve 11, the developer 18~30 were plotted by bulk-compensated specific gravity and angle of repose as shown in FIG. 13 in the same manner as described for developers 1~17. Developer transport in a uniform thin layer state is indicated by the solid circle (●) symbol, and developer transport in an irregular layer state is indicated by the standard circle (○) symbol. When satisfactory developers 18, 19, 22, and 23, i.e., bulk-compensated specific gravity of 0.28~0.37 and angle of repose of 38°~52°, were used, uniformly thin layer of developer 1 was transported to the developing region by developing sleeve 11. In contrast, when unsatisfactory developers 20, 21, and 24~30, were used, there was flocculation of the developer transported to the developing region by developing sleeve 11, which caused irregular thickness of the layer of developer.

Evaluation of the obtained images was performed in the same manner as described in relation to Table 12. Evaluation results are shown in Table 15.

TABLE 15

| Developer | Density irregularity | Texture | Overall evaluation |
|---|---|---|---|
| 18 | 5 | 4 | B |
| 19 | 5 | 4 | B |
| 20 | 3 | 2 | D |
| 21 | 3 | 3 | C |
| 22 | 5 | 5 | A |
| 23 | 5 | 5 | A |
| 24 | 3 | 3 | C |
| 25 | 4 | 3 | C |
| 26 | 1 | 1 | E |
| 27 | 1 | 1 | E |
| 28 | 1 | 1 | E |
| 29 | 1 | 1 | E |
| 30 | 2 | 2 | D |

Satisfactory developers 18, 19, 22, and 23 exhibited scant density irregularity in the obtained images, and all were rated at B or higher for fine texture in the overall evaluation. In contrast, unsatisfactory developers 20, 21, and 24~30 exhibited density irregularity in the obtained images, and were rated at C or lower for poor texture.

Developers (h)~(m) are examples wherein the amount of transported developer was outside the range of 0.7~5.0 mg/cm². Each developer was evaluated for density irregularity and carrier adhesion by the same evaluation method as described in reference to Table 13. The evaluation results are shown in Table 16.

TABLE 16

| Developer | Density | Carrier adhesion |
|---|---|---|
| (h) | 1.25 | 5 |
| (i) | 1.34 | 2 |
| (j) | 1.18 | 5 |
| (k) | 1.42 | 2 |
| (l) | 1.21 | 5 |
| (m) | 1.37 | 2 |

The influence of the oscillating electric field on developing sleeve 11 in developing device 10 were investigated.

To 100 parts-by-weight of styrene-acrylic resin were added 200 parts-by-weight 200 parts-by-weight magnetic powder and carbon black and silicon oxide to obtain a binder type carrier having a mean particle size of 20 μm, true specific gravity of 2.4, magnetic force of 1050 G/cm$^3$, and electrical resistance of $1\times10^{14}$ Ω·cm for use as the carrier in developer 1. Carbon black, wax, and positive charge-regulating agent (nigrosine; Oriental Chemical Co., Ltd.) were added to styrene-acrylic resin, and silicon oxide was added to obtain a positive charging toner having a mean particle size of 11 μm.

The aforesaid carrier and toner were mixed to obtain a developer having a toner concentration of 20 percent-by-weight. In developing device 10, the amount of developer 1 transported to the developing region by developing sleeve 11 was regulated by magnetic blade 13*a*, such that the transported amount of developer 1 was 2.5 mg/cm$^2$ and 30 mg/cm$^2$.

Then, developing was accomplished using developing device 10. The circumferential speed of photosensitive member 2 was set at 120 mm/s, the surface potential of the photosensitive member receiving toner was set at −440 V, and the surface potential of the photosensitive member 2 not receiving toner was set at −210 V.

A developing bias voltage comprising −250 V DC with an overlaid AC current having a peak-to-peak value Vp-p of 0~3 kV and duty ratio (developing:recovery) of 1:1 with a square wave frequency of 2 kHz was supplied from developing bias power source 12. The space Ds between developing sleeve 11 and photosensitive member 1 in the developing region was set at 0.3~0.6 mm, and the intensity of the oscillating electric field (Vp-p/Ds) which acted in the developing region was varied.

The amount of developer 1 transported to the developing region by developing sleeve 11 was regulated to 2.5 mg/cm$^2$ and 30 mg/cm$^2$, and in each case the intensity of the oscillating electric field (Vp-p/Ds) acting in the developing region was varied to examine the relationship between the intensity of said oscillating electric field and the potential attenuation of the layer of developer on developing sleeve 11. The results are shown in FIG. 7. The potential attenuation of the developer layer was determined by supplying toner from the developer on developing sleeve 11 to photosensitive member 2, and stopping the development midway, and measuring the electric potential of the developer layer on said developing sleeve 11. The electric potential of the developer layer when the AC voltage was not applied was designated 1, and potential attenuation was expressed as the ratio of the two values. When the oscillating electric field (Vp-p/Ds) acting in the developing region was excessively weakened, there was only slight attenuation of the potential in the layer of developer, such that movement of the charge of the carrier deteriorates after toner is supplied and developing is achieved, resulting in a residual countercharge remaining on the majority of the carrier which causes a majority of the carrier to adhere to the photosensitive member 2. However, when the oscillating electric field is too strong at over 5.5 kV/mm, leaks occur between the developing sleeve 11 and photosensitive member 2.

On the other hand, when the intensity of the oscillating filed (Vp-p/Ds) is regulated within a range of 3.5~5 kV/mm and the amount of developer 1 transported by developing sleeve 11 is set at 2.5 mg/cm$^2$ which is within the range of 0.7~5.0 mg/cm$^2$, the attenuation of potential of the developer layer increases and the developer layer is completely ionized, such that there is rapid movement of the charge remaining on the carrier after toner is supplied, thereby preventing adhesion f the carrier on photosensitive member 2. In contrast, when the amount of transported developer 1 is set at 30 mg/cm$^2$, there is only slight potential attenuation of the developer layer regardless of the action of the oscillating field within a range of 3.5~5 k V/mm, such that there is poor movement of the charge remaining on the carrier after toner is supplied which causes a countercharge to remain on the majority of the carrier that leads to adhesion of a large amount of carrier on photosensitive member 2.

Then, the toner concentration in the developer was regulated within a range of 5~30 percent-by-weight, and the amount of developer transported by developing sleeve 11 in developing device 10 was varied within a range of 2~10 mg/cm$^2$, as shown in Table 17 below.

When developing using developing device 10, the circumferential speed of photosensitive member 2 was set at 120 mm/s, and the circumferential speed of developing sleeve 11 was regulated within a range of 1 to 3 times the speed of photosensitive member 2. The surface potential of the photosensitive member receiving toner was set at −440 V, and the surface potential of the photosensitive member 2 not receiving toner was set at −210 V. A developing bias voltage comprising −400~+640 V DC with an overlaid AC current having a duty ratio (developing:recovery) of 1:1~1:3 with a square wave frequency of 2~4 kHz was supplied from developing bias power source 12.

The peak-to-peak value Vp-p of the AC voltage was regulated within a range of 0.75~3 kV, and the space Ds between developing sleeve 11 and photosensitive member 2 in the developing region was set within a range of 0.3~0.6 mm. The oscillating field (Vp-p/Ds) acting in the developing region was varied within a range of 2.5~5 kV/mm, as shown in Table 17.

The amount of developer 1 transported by developing sleeve 11 and the oscillating field (Vp-p/Ds) acting in the developing region were varied as indicated in Table 17, and the state of the carrier adhering to photosensitive member 2 was investigated under the aforesaid conditions, and the results are shown in Table 17. In Table 17, the state of carrier adhesion on photosensitive member 2 was evaluated visually in five levels. Complete lack of carrier adhesion was rated 5, slight carrier adhesion was rated 4, some carrier adhesion was rated 3, definite carrier adhesion was rated 2, and complete carrier adhesion was rated 1. When the oscillating field acting in the developing region was excessively strong so as to cause leaking to photosensitive member 2, the situation is indicated by "leak" in the table.

TABLE 17

| Amount of developer transported | Oscillating field (KV/mm) | | | | | | |
|---|---|---|---|---|---|---|---|
| (mg/cm$^2$) | 2.5 | 3.0 | 3.5 | 4.0 | 4.5 | 5.0 | 5.5 |
| 2 | 3 | 3~4 | 5 | 5 | 5 | 5 | Leak |
| 5 | 3 | 3~4 | 5 | 5 | 5 | 5 | Leak |
| 10 | 2 | 2~3 | 3~4 | 3~4 | 3~4 | 3~4 | Leak |

As can be understood from the results shown in the table, in the present invention, unexpected results were obtained relative to carrier adhesion when the amount of developer transported is within a range of 2 mg/cm$^2$ and 5 mg/cm$^2$ and the oscillating field value is set at 3.5~5.0 kV/mm. That is, a marked increase in the prevention of carrier adhesion was not observed when the amount of transported developer was set outside the range of the present invention at 10 mg/cm$^2$, and an oscillating field of 3.5~5.0 kV/mm was applied, and complete nonadhesion of carrier (rank 5) unexpectedly occurred when the amount of transported developer was set at 2 mg/cm$^2$ and 5 mg/cm$^2$ in combination with an oscillating field of 3.5~5.0 kV/mm.

In the previously described embodiments, developing is described using only developing device 10 of FIG. 6, however, the type of developing device used is not specifically limited in the present invention. For example, developing device 10 such as that shown in FIG. 14 may be used wherein developer 1 accommodated in developing device 10 is mixed by a mixing member 16 and the mixed developer 1 is supplied to developing sleeve 11, and thereafter a regulating plate **13*b* acting as regulating member 13 comes into contact with the surface of developing sleeve 11 to regulate the amount of developer 1 on developing sleeve 11, and residual developer 1 remaining on the surface of developing sleeve 11 after developing is collected therefrom by collecting roller 17 which returns the collected developer 1 to inside developing device 10**.

Figure 14:
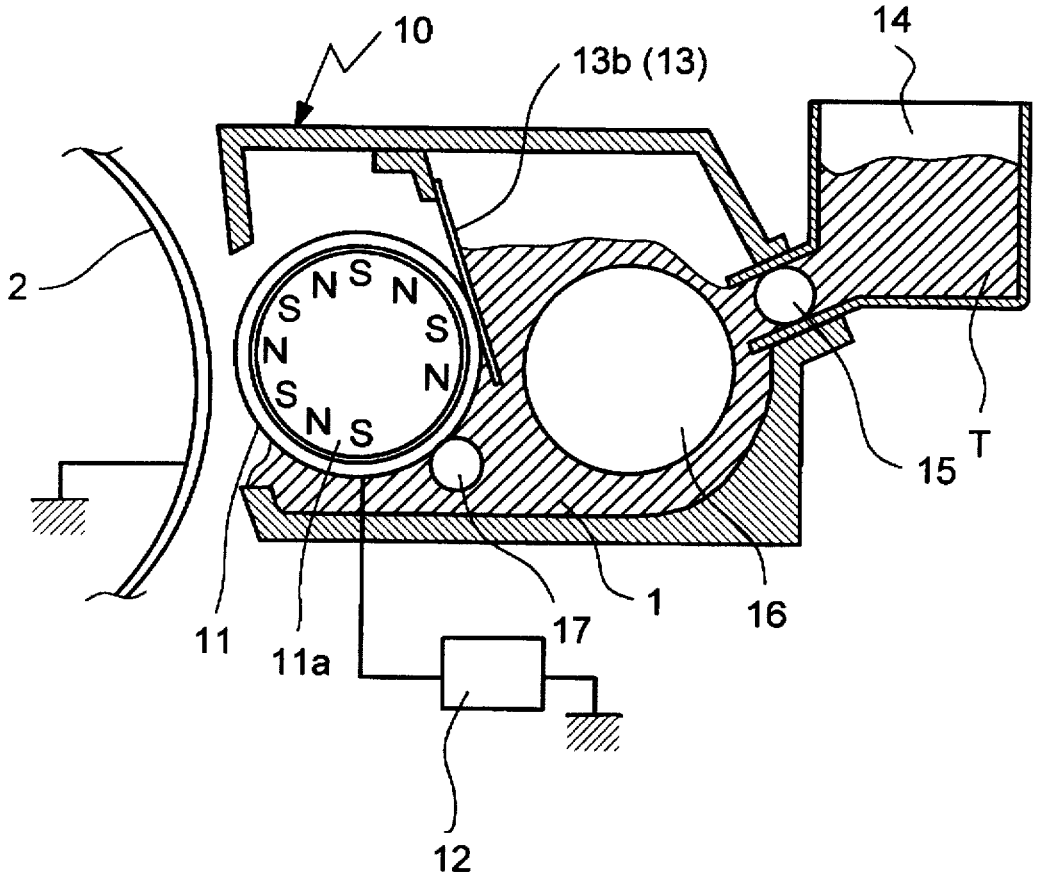
FIG. 14 shows another developing device using an embodiment of the developing method of the present invention.
Figure 15:
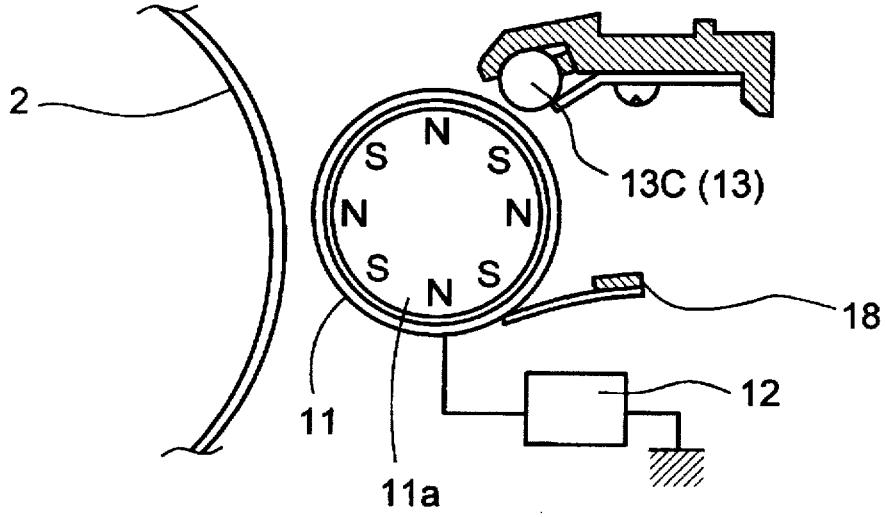
FIG. 15 shows the amount of developer on the developing sleeve regulated by a regulating rod in another embodiment of the developing method of the present invention.

Furthermore, the method of regulating the amount of developer 1 transported to the developing region by developing sleeve 11 is not specifically limited to the methods described in terms of developing devices 10 shown in FIGS. 6 and 14. For example, a regulating rod **13*c* may be provided opposite developing sleeve 11 with a predetermined spacing interposed therebetween, such that the amount of developer 1 on the surface of developing sleeve 11 is regulated by said regulating rod 13*c*. In the device shown in FIG. 15, the residual developer remaining on the surface of developing sleeve 11 after developing may be removed therefrom by a scraping plate 18 to collect the developer and return it to the inside of developing device 10**.

In the developing methods of the present invention as previously described, a developer comprising a toner and a carrier is transported to a developing region opposite an image-bearing member by a developer transporting member, and developing is accomplished by supplying toner from the developer on the developer transporting member to the image-bearing member in the developing region. The amount of transported developer delivered to the developing region on the developer transporting member is preferably regulated as previously described to produce images having excellent image density. Adhesion of the carrier on the image-bearing member is suppressed, thereby preventing carrier-induced nonprinting spots in the obtained image, as well as damage to the image-bearing member due to adhered carrier, and streak-like and spot-like noise in the image. Thus, excellent images are stably produced with scant airborne toner dispersion.

In the developing method of the present invention the developer used preferably has a bulk-compensated specific gravity and angle of repose within the previously described ranges, such that developer flocculation on the developer transporting member and developer layer thickness irregularities of the developer transported by the developer transporting member do not occur even when the amount of developer transported to the developing region by the developer transporting member is regulated as previously described. Thus, the developer is uniformly distributed on the developer transporting member to allow the formation of a finely textured magnetic brush of developer, such that fine texture, high resolution images are obtained without image irregularities even in the case of halftone images.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A developing method for developing an electrostatic latent image at a developing region, said method comprising steps of:

preparing a developer containing toner particles and carrier particles which has an inherent resistance value of $1\times10^7$~$1\times10^{12}$ Ω·cm under an electric field of 500V/mm, magnetic force of 600~2300 G, and a mean particle size of 10~30 μm;

regulating a quantity of the prepared developer on a developer transporter within a range of 0.7~5.0 mg/cm$^2$;

transporting the regulated developer to the developing region; and applying an alternating current voltage between the developing region and the electrostatic latent image to generate an oscillating electric field therebetween in order to supply the transported developer to the electrostatic latent image.

2. The developing method as claimed in claim 1, wherein the alternating current voltage has a peak-to-peak voltage of 700~2000 V.

3. The developing method as claimed in claim 2, further comprising the step of applying a direct current voltage between the developing region and the electrostatic latent image.

4. A developing method for developing an electrostatic latent image at a developing region, said method comprising steps of:

preparing a developer containing toner particles and carrier particles;

regulating a quantity of the prepared developer on a developer transporter within a range of 0.7~5.0 mg/cm$^2$;

transporting the regulated developer to the developing region; and applying an alternating current voltage between the developing region and the electrostatic latent image to generate an oscillating electric field to supply the transported developer to the electrostatic latent image wherein the oscillating electric field is expressed by the following formula:

$$5kV/mm \geqq (Vp\text{-}p/Ds) \geqq 3.5kV/mm$$

wherein the Vp-p is peak-to-peak value of the applied alternating current voltage, and Ds is a distance between the developing region and the electrostatic latent image.

5. The developing method as claimed in claim 4, wherein a ratio of the toner particles to the carrier particles is 10~25 wt % and the alternating current voltage has a peak-to-peak voltage of 700~2000 V.

6. The developing method as claimed in claim 4, wherein a ratio of the transporting speed of developer to a speed of the electrostatic latent image is regulated within a range of 1~3.

7. The developing method as claimed in claim 4, wherein the transporting quantity of the developer is expressed by the following formula:

$$(\text{transporting quantity of developer})\times\theta\times(Tc/100) \geqq 0.5\ mg/cm2$$

wherein θ represents a ratio of a transporting speed of developer to a speed of the electrostatic latent image and Tc represents a ratio of toner particles to carrier particles.

8. The developing method as claimed in claim 4, wherein Ds is regulated to a range of 0.3~0.6 mm.

9. A developing method for developing an electrostatic latent image at a developing region, said method comprising steps of:

preparing a developer containing toner particles and carrier particles which has a bulk-compensated specific gravity of 0.28~0.37 and an angle of repose of 38°~52°;

regulating a quantity of the prepared developer on a developer transporter within a range of 0.7~5.0 mg/cm$^2$;

transporting the regulated developer to the developing region; and applying an electric field between the developing region and the electrostatic latent image to supply the transported developer to the electrostatic latent image.

10. The developing method as claimed in claim 9, wherein the electric field is an oscillating electric field between 3.5~5.0 kV/mm.

11. The developing method of claim 1, further comprising the step of holding the developer on a developer transporter, said developer transporter including a rotating member and a magnetic member which is fixed within the rotating member and wherein the developer is regulated by a magnetic regulating member forming a regulating area which is formed between the regulating member and the surface of the developer transporter.

12. The developing method of claim 1, wherein the carrier particles are binder type carrier particles.

13. The developing method of claim 1, wherein the developer transporter includes a built in magnet roller and the regulating step includes regulating the developer with a magnetic blade.

14. The developing method of claim 4, wherein the carrier particles are binder type carrier particles.

15. The developing method of claim 4, wherein the developer transporter includes a built in magnet roller and the regulating step includes regulating the developer with a magnetic blade.

16. The developing method of claim 9, wherein the carrier particles are binder type carrier particles.

17. The developing method of claim 9, wherein the developer transporter includes a built in magnet roller and the regulating step includes regulating the developer with a magnetic blade.

18. The developing method of claim 12, wherein the developer transporter includes a built in magnet roller and the regulating step includes regulating the developer with a magnetic blade.

19. The developing method of claim 14, wherein the developer transporter includes a built in magnet roller and the regulating step includes regulating the developer with a magnetic blade.

20. The developing method of claim 16, wherein the developer transporter includes a built in magnet roller and the regulating step includes regulating the developer with a magnetic blade.

* * * * *